US007786664B2

(12) United States Patent
Kobayashi

(10) Patent No.: US 7,786,664 B2
(45) Date of Patent: Aug. 31, 2010

(54) PLANE DISPLAY DEVICE

(75) Inventor: Shigeki Kobayashi, Gifu (JP)

(73) Assignee: Sony Corporation, Tokyo (JP)

( * ) Notice: Subject to any disclaimer, the term of this patent is extended or adjusted under 35 U.S.C. 154(b) by 407 days.

(21) Appl. No.: 11/826,576

(22) Filed: Jul. 17, 2007

(65) Prior Publication Data

US 2008/0024050 A1 Jan. 31, 2008

(30) Foreign Application Priority Data

Jul. 26, 2006 (JP) ..... 2006-202698

(51) Int. Cl.
*H01J 1/62* (2006.01)

(52) U.S. Cl. ..... 313/495; 313/496

(58) Field of Classification Search ..... 313/309–311, 313/495–497, 582–587
See application file for complete search history.

(56) References Cited

U.S. PATENT DOCUMENTS

| | | | | |
|---|---|---|---|---|
| 5,463,276 | A * | 10/1995 | Kawasaki et al. | 313/496 |
| 5,602,443 | A * | 2/1997 | Igeta et al. | 313/477 R |
| 5,965,978 | A * | 10/1999 | Kishino et al. | 313/496 |
| 6,114,804 | A * | 9/2000 | Kawase et al. | 313/495 |
| 6,407,500 | B1 * | 6/2002 | Tsuburaya et al. | 313/495 |
| 6,528,939 | B1 | 3/2003 | Kawase et al. | |
| 6,831,402 | B2 * | 12/2004 | Kamiguchi | 313/495 |
| 6,858,980 | B2 * | 2/2005 | Kamiguchi | 313/495 |
| 6,967,434 | B2 * | 11/2005 | Kamiguchi | 313/495 |
| 7,154,216 | B2 * | 12/2006 | Kamiguchi | 313/495 |
| 7,417,365 | B2 * | 8/2008 | Nakamura et al. | 313/495 |
| 2002/0195926 | A1 | 12/2002 | Kawase | |
| 2003/0025443 | A1 * | 2/2003 | Kamiguchi | 313/495 |
| 2003/0137235 | A1 * | 7/2003 | Yamanobe et al. | 313/495 |
| 2004/0130259 | A1 | 7/2004 | Kamiguchi | |
| 2005/0206299 | A1 * | 9/2005 | Nakamura et al. | 313/495 |
| 2006/0267477 | A1 * | 11/2006 | Hirasawa et al. | 313/495 |

FOREIGN PATENT DOCUMENTS

| | | |
|---|---|---|
| JP | 61-135029 | 6/1986 |
| JP | 10-31433 | 2/1989 |
| JP | 5-114372 | 5/1993 |
| JP | 2000-251786 | 9/2000 |
| JP | 2000-260359 | 9/2000 |
| JP | A 2003-524280 | 8/2003 |
| JP | A 2004-500688 | 1/2004 |
| JP | 2004-111376 | 4/2004 |

* cited by examiner

*Primary Examiner*—Bumsuk Won
(74) *Attorney, Agent, or Firm*—Rader, Fishman & Grauer PLLC

(57) ABSTRACT

An embodiment of the invention provides a plane display device in which a cathode panel having a plurality of electron emitting areas provided therein, and an anode panel having phosphor layers and an anode electrode provided therein are joined to each other in their peripheral portions, and a space defined between the cathode panel and the anode panel is kept at a vacuum, the plane display device, including: an exhaust tube made of a conductive material, the exhaust tube having one end portion communicating with the space, and the other end portion located outside the plane display device; and an elastic member made of a conductive material; in which the exhaust tube and the anode electrode are electrically connected to each other through the elastic member disposed in the space; and a predetermined voltage is applied to the anode electrode through the exhaust tube and the elastic member.

7 Claims, 9 Drawing Sheets

PLANE DISPLAY DEVICE

CROSS REFERENCES TO RELATED APPLICATIONS

The present invention contains subject matter related to Japanese Patent Application JP 2006-202698 filed in the Japan Patent Office on Jul. 26, 2006, the entire contents of which being incorporated herein by reference.

BACKGROUND OF THE INVENTION

1. Field of the Invention

The present invention relates to a plane display device.

2. Description of the Related Art

A plane display device (having a flat panel form) is variously examined as an image display device which can substitute for a cathode-ray tube (CRT). A liquid crystal display device (LCD), an electroluminescence display device (ELD), and a plasma display device (PDP) can be exemplified as such a plane display device. In addition, the development of a plane display device having electron emitting elements incorporated therein is also carried out. Here, a cold cathode field electron emitting element, a metal/insulating film/metal type element (called an MIM element as well), and a surface-conduction type electron emitting element are known as the electron emitting element. The plane display device having such an electron emitting element incorporated therein as an electron emitting source receives the attention from a viewpoint of a high resolution, color display with a high luminance, and low power consumption.

The cold cathode field emission display device (may be hereinafter simply abbreviated as "the display device") as the plane display device having the cold cathode field emitting elements incorporated therein as the electron emission source generally has a construction in which a cathode panel and an anode panel are disposed so as to face each other through a space kept at a vacuum. Here, the cathode panel has an electron emitting area corresponding to pixels (sub-pixels in the case of the color display) arranged in two-dimensional matrix. Also, the anode panel has phosphor layers which are excited through collision of electrons emitted from the electron emitting areas therewith, thereby emitting lights. Normally, one or plural cold cathode field emission elements (may be abbreviated hereinafter as "the field emission element") are provided in the plane display device. A spindt type field emission element, a flat type field emission element, an edge type field emission element, a plane type field emission element, and the like can be given as the field emission element.

FIG. 8 is a conceptual partial end view of a related art display device having a spindt type field emission element as an example. FIG. 9 is a schematic exploded perspective view of parts of a cathode panel CP and an anode panel AP when the cathode panel CP and the anode panel AP are exploded.

In order to maintain the degree of vacuum of a space defined between the cathode panel CP and the anode panel AP, a getter 62 made of a material which can get a residual gas within the space is disposed in such a display device. The getter 62 is normally disposed in a non-effective area (a frame-like area surrounding an effective area) of at least one of the cathode panel CP and the anode panel AP. In the example shown in FIG. 8, one or plural through holes 61 (one through hole 61 in the example shown in FIG. 8) are provided in the cathode panel CP. A getter box 60 which, for example, is made of a glass is mounted to a supporting body 10 so as to close up the through hole 61 from the outside of the cathode panel CP. Also, the getter 62 is accommodated in the getter box 60. Another through hole 50 for evacuation is provided in another portion of the non-effective area. An exhaust tube 51, called a tip tube as well, which is sealed after the evacuation is mounted to the through hole 50.

The spindt type field emission element constituting this display device includes cathode electrodes 11, an insulating layer 12, gate electrodes 13, opening portions 14 (each having a first opening portion 14A provided in each of the gate electrodes 13, and a second opening portion 14B provided in the insulating layer 12), and conical electron emitting portions 15. Here, the cathode electrodes 11 are formed on the supporting body 10. The insulating layer 12 is formed on the supporting body 10 and each of the cathode electrodes 11. The opening portions 14 are formed in each of the gate electrodes 13, and the insulating layer 12. Also, each of the conical electron emitting portions 15 is formed on a corresponding one of the cathode electrodes 11 located in a bottom portion of corresponding one of the opening portions 14.

In this display device, each of the cathode electrodes 11 extends in a first direction (in a Y direction in FIGS. 8 and 9). Each of the gate electrodes 13 extends in a second direction (in an X direction in FIGS. 8 and 9) different from the first direction. In general, the cathode electrodes 11 and the gate electrodes 13 are formed in strip shapes in the directions, respectively, along which projected images of the cathode electrodes 11 and the gate electrodes 13 intersect each other perpendicularly. Overlap areas in which the strip-shaped cathode electrodes 11 and the strip-shaped gate electrodes 13 overlap each other are electron emitting areas EA, respectively. Each of the electron emitting areas EA corresponds to an area for one sub-pixel. Also, such electron emitting areas EA are normally arranged in a two-dimensional matrix within the effective area (an area corresponding to a display area of the display device) of the cathode panel CP.

On the other hand, phosphor layers 22 (more specifically, a red emission phosphor layer 22R, a green emission phosphor layer 22G, and a blue emission phosphor layer 22B) having a predetermined pattern are formed on the substrate 20. Thus, the anode panel AP has a structure in which the phosphor layers 22 are covered with the anode electrode 24. Note that, a space defined between the adjacent phosphor layers 22 is filled with a light absorbing layer (black matrix) 23 made of a light absorbing material such as carbon. As a result, color turbidity and an optical crosstalk of the displayed image are prevented from being generated. In FIG. 8, reference numeral 21 designates a partition wall, reference numeral 40 designates a spacer, for example, having a plate-like shape, and reference numeral 25 designates a spacer holding portion. Also, reference numeral 26 designates a joining member made of a joining material such as a frit glass, a reference numeral 16 designates an interlayer insulating layer, and reference numeral 17 designates a converging electrode. Note that, illustrations of the partition walls, the spacers, the spacer holding portion, the converging electrode, and the interlayer insulating layer are omitted in FIG. 9 for the sake of simplicity.

The anode electrode 24 has an antistatic function for the phosphor layers 22 in addition to a function as a reflecting film for reflecting lights emitted from the phosphor layers 22, respectively. In general, the electrons recoiling from the phosphor layers 22, or the secondary electrons emitted from the phosphor layers 22 collide with other phosphor layers 22, so that the so-called optical crosstalk (color turbidity) occurs. In order to avoid this situation, the partition wall 21 has a function of preventing the optical crosstalk from being generated.

One sub-pixel is constituted by the electron emitting area EA on the cathode panel side, and the phosphor layer 22, on the anode panel side, facing the electron emitting area EA. In the case of the color display device, one pixel is constituted by a set of one red emission phosphor layer, one green emission phosphor layer, and one blue emission phosphor layer. Such pixels, for example, are arranged on the order of several hundreds of thousands to several millions in the effective area.

Also, the anode panel AP and the cathode panel CP are disposed so that the electron emitting areas EA face the phosphor layers 22, respectively, and are joined to each other through the joining member 26 in their peripheral portions. After that, air in the space defined among the anode panel AP, the cathode panel CP and the joining member 26 is exhausted, and the space defined thereamong is sealed. As a result, the display device can be manufactured. In this case, the space defined among the anode panel AP, the cathode panel CP and the joining member 26 is kept at a high vacuum (for example, equal to or lower than $1\times10^{-3}$ Pa).

A cathode electrode controlling circuit 31 applies a relatively negative voltage to each of the cathode electrodes 11. A gate electrode controlling circuit 32 applies a relatively positive voltage to each of the gate electrodes 13. A converging electrode controlling circuit (not shown) applies a relatively negative voltage (for example, 0 V) to each of the converging electrodes 17. Also, an anode electrode controlling circuit 33 applies a higher positive voltage than that applied to each of the gate electrodes 13 to the anode electrode 24. When a desired image is displayed on such a display device, for example, the cathode electrode controlling circuit 31 inputs a scanning signal to each of the cathode electrodes 11, and the gate electrode controlling circuit 32 inputs a video signal corresponding to the desired image to each of the cathode electrodes 13. Alternatively, the cathode electrode controlling circuit 31 inputs a video signal corresponding to the desired image to each of the cathode electrodes 11, and the gate electrode controlling circuit 32 inputs a scanning signal to each of the gate electrodes 13. Electrons are emitted from the electron emitting portions 15 in accordance with the quantum tunneling effect caused by electric fields generated when voltages are applied across the cathode electrodes 11 and the gate electrodes 13, respectively. The anode electrode 24 attracts the electrons thus emitted, so that the electrons penetrate the anode electrode 24 to collide with the corresponding phosphor layers 22, respectively. As a result, the phosphor layers 22 are excited to emit lights, respectively, thereby enabling a desired image to be obtained. In other words, the operation of the cold cathode field electron emission display device is basically controlled in accordance with the voltage applied to each of the gate electrodes 13, and the voltage applied to each of the cathode electrodes 11.

As has been described above, the high positive voltage is applied to the anode electrode 24. Therefore, the anode electrode 24 and the anode electrode controlling circuit 33 must be electrically connected to each other with a highly reliable structure. For example, a plane display device described in Japanese Patent Laid-Open No. Hei 5-114372 uses a feeding terminal which is disposed so as to contact an anode electrode through a hole portion formed in a cathode panel. More specifically, the plane display device described in Japanese Patent Laid-Open No. Hei 5-114372 includes a chip tube as a sealing body, and a fluorescent screen feeding terminal. In this case, the fluorescent screen feeding terminal is constituted by two parts having an elastic body and a terminal deriving portion. Also, one end of the terminal deriving portion extends completely through the sealing body 18 to protrude to the outside.

SUMMARY OF THE INVENTION

However, in the plane display device having the above-mentioned constitution and construction, the fluorescent screen feeding terminal is complicated in construction, and it is easy to cause a problem in holding of an air leakage efficiency between a portion of the terminal deriving portion extending completely through the sealing body, and the sealing body. Moreover, it is necessary to perform the exhaust for the inside of the display device, the sealing processing with the sealing body, and the like in a state in which the fluorescent screen feeding terminal is held in the predetermined position by using a member, a jig and the like for fixing the fluorescent screen feeding terminal. As a result, the processes for manufacturing the plane display device are complicated.

In the light of the foregoing, it is a desirable to provide a plane display device which is capable of simplifying an entire construction of a mechanism for applying a voltage to an anode electrode, and an exhaust tube, readily performing exhaust through the exhaust tube, and having a construction with which a problem is hardly caused in an air leakage efficiency of the exhaust tube.

According to a first embodiment of the present invention, there is provided a plane display device in which a cathode panel having a plurality of electron emitting areas provided therein, and an anode panel having phosphor layers and an anode electrode provided therein are joined to each other in their peripheral portions, and a space defined between the cathode panel and the anode panel is kept at a vacuum, the plane display device, including:

an exhaust tube made of a conductive material, the exhaust tube having one end portion communicating with the space, and the other end portion located outside the plane display device; and an elastic member made of a conductive material;

in which the exhaust tube and the anode electrode are electrically connected to each other through the elastic member disposed in the space; and a predetermined voltage is applied to the anode electrode through the exhaust tube and the elastic member.

According to a second embodiment of the present invention, there is provided a plane display device in which a cathode panel having a plurality of electron emitting areas provided therein, and an anode panel having phosphor layers and an anode electrode provided therein are joined to each other in their peripheral portions, and a space defined between the cathode panel and the anode panel is kept at a vacuum, the plane display device, including:

an exhaust tube made of a conductive material, the exhaust tube having one end portion communicating with the space, and the other end portion located outside the plane display device;

in which one end portion of the exhaust tube directly contacts the anode electrode; and a predetermined voltage is applied to the anode electrode through the exhaust tube.

In the plane display device according to the first or second embodiment of the present invention, the exhaust tube can be directly mounted to the cathode panel or the anode panel which constitutes the plane display device, or to a joining member which will be described later. Or, a getter box which communicates with the space is mounted to the cathode panel and/or the anode panel. Thus, the exhaust tube can also be mounted to the getter box. Here, the exhaust tube can be mounted to the getter box by using a frit glass or a low melting point metal material which will be described later. In a process for assembling the plane display device, the getter box to which the exhaust tube is previously mounted may be mounted to the cathode panel and/or the anode panel. Or, the exhaust tube may be mounted to the getter box after the getter box is mounted to the cathode panel and/or the anode panel.

In addition, in the plane display device according to the first embodiment of the present invention, preferably, one end of the elastic member abuts against or is pressed to the anode electrode, and the other end thereof is fixedly fastened to the exhaust tube. However, the present invention is not limited to this construction. That is to say, one end of the elastic member may abut against or be pressed to the exhaust tube, and the other end thereof may be fixedly fastened to the anode electrode in a contact state.

In the plane display device according to the first or second embodiment of the present invention, the exhaust tube and the anode electrode are electrically connected to each other through the elastic member disposed inside the plane display device, or one end portion of the exhaust tube directly contacts the anode electrode. However, "the anode electrode" stated herein includes not only the anode electrode included in an effective area (a display area at a central portion performing a practical function as the plane display device), but also a portion of an anode electrode located in a non-effective area (a frame-like area surrounding the effective area), and an electrode formed so as to extend from the anode electrode.

In the plane display device according to the first or second embodiment of the present invention, the space is exhausted through the exhaust tube. The exhaust tube can be constituted by a hollow tube made of a metal or an alloy [for example, an iron (Fe) alloy containing therein 42 weight % nickel (Ni), or an iron (Fe) alloy containing therein 42 weight % nickel (Ni) and 6 weight % chromium (Cr)] having a low thermal expansion coefficient. For example, the exhaust tube is disposed so as to correspond to a through hole provided in the non-effective area of the cathode panel. In this case, the exhaust tube can also be fixedly fastened to the cathode panel, the getter box or the like by using a low melting point metal material which will be described later. After the space in the inside of the plane display device reaches a predetermined degree of vacuum, the exhaust tube can be readily sealed by, for example, bonding the cathode panel, the getter box or the like to the other end portion of the exhaust tube by the application of a pressure. Note that, when a temperature of the plane display device is caused to drop after the plane display device is temporarily heated before the completion of the sealing, suitably, a residual gas can be discharged to the space, and can be exhausted to the outside of the space.

The well known metal materials such as a nickel alloy such as an Inconel brand (registered trademark) alloy, and a stainless steel can be generally exemplified as the material of which the elastic member is made. A construction of the elastic member is not especially limited. For example, the elastic member may be constituted by a flat spring or by a coil spring.

A glass substrate, a glass substrate having an insulating film formed on its surface, a quartz substrate, a quartz substrate having an insulating film formed on its surface, and a semiconductor substrate having an insulating film formed on its surface can be given as a supporting body constituting the cathode panel or the substrate constituting the anode panel. However, the glass substrate or the glass substrate having the insulating film formed on its surface is preferably used from a viewpoint of reduction of a manufacture cost. A high strain point glass, a low alkaline glass, an alkali-free glass, a soda glass ($Na_2O.CaO.SiO_2$), a boro-silicate glass ($Na_2O.B_2O_3.SiO_2$), a forsterite ($2MgO.SiO_2$), and a lead glass ($Na_2O.PbO.SiO_2$) can be exemplified as a glass material for the glass substrate. The getter box may also be made of any of these glass materials. Or, the getter box may also be made of any of ceramic materials which will be described later for a material of which a spacer is made.

A so-called non-evaporation type getter material of at least one kind of material selected from the group consisting of titanium (Ti), zirconium (Zr), nickel (Ni), vanadium (V), aluminum (Al), iron (Fe), cobalt (Co), a Zr—Ni alloy, a Ti—Zr—V—Fe alloy, a Ti—Zn—Al alloy, a Ti—Mn—V alloy, a carbon fiber, and graphite; and a so-called evaporation type getter material such as barium (Ba) or Ba—Al can be given as a material of which the getter for getting the residual gas is made. Note that, the non-evaporation type getter material and the evaporation type getter material can be used together with each other. In the case of the evaporation type getter material, such a getter material is heated and is evaporated, thereby being stuck to an inner wall of the getter box. On the other hand, in the case of the non-evaporation type getter material, the getter material is activated by being heated. The heating using a laser beam, the heating using a high frequency, the heating using a heating furnace, the heating using a lamp, and the heating using a heating wire can be given for the method of heating the getter material.

When the cathode panel and the anode panel are joined to each other in their peripheral portions by using the joining member, the entire joining member can be made of a joining material such as a frit glass. Or, the joining member can be constituted by a rod-like or frame-like rigid material such as a glass or ceramics, a joining material layer provided on a surface, on the cathode panel side, of the frame body, and a joining material layer provided on a surface, on the anode panel side, of the frame body. A height of the frame body is suitably selected, which results in that a facing distance between the cathode panel and the anode panel can be set longer than that in the case where the entire joining member is made of the joining material. A frit glass such as a $B_2O_3$—PbO system frit glass, or an $SiO_2$—$B_2O_3$—PbO system frit glass is generally used as the joining material or the material of which the joining material layer is made. However, a so-called low melting point metal material having a melting point of about 120 to about 400° C. may also be used. Indium (In having a melting point of 157° C.); an indium-gold system low melting point alloy; a tin (Sn) system high temperature solder such as $Sn_{80}Ag_{20}$ (having a melting point of 220 to 370° C.), $Sn_{95}Cu_5$ (having a melting point of 227 to 370° C.), a lead (Pb) system high temperature solder such as $Pb_{97.5}Ag_{2.5}$ (having a melting point of 304° C.), $Pb_{94.5}Ag_{5.5}$ (having a melting point of 304 to 365° C.), or $Pb_{97.5}Ag_{1.5}Sn_{1.0}$ (having a melting point of 309° C.); a zinc (Zn) system high temperature solder such as $Zn_{95}Al_5$ (having a melting point of 380° C.); a tin-lead system standard solder such as $Sn_5Pb_{95}$ (having a melting point of 300 to 314° C.) or $Sn_2Pb_{98}$ (having a melting point of 316 to 322° C.); and a brazing filler metal such as $Au_{88}Ga_{12}$ (having a melting point of 381° C.) can be exemplified for such a low melting point metal material. Here, in the materials described above, all the suffixes represent atomic %.

When the cathode panel and the anode panel are joined to each other by using the joining member, the cathode panel and the anode panel may be simultaneously joined to each other by using the joining member. Or, one of the cathode panel and the anode panel may be joined to the joining member in a first stage, and the other of the cathode panel and the anode panel may be joined to the joining member in a second stage. After the joining of the cathode panel and the anode panel using the joining member is completed, the space defined among the cathode panel, the anode panel and the joining member is exhausted to be kept at a vacuum. A pressure of the ambient atmosphere in a phase of the joining may be either a normal pressure or a reduced pressure. In addition, the gas in the ambient atmosphere may be air, a nitrogen gas, or an inactive gas containing therein a gas (for example, an Ar gas) belonging to a zero group in the periodic series.

When the getter box is mounted to the cathode panel and/or the anode panel, a time point at which the getter box is mounted to the cathode panel and/or the anode panel is essentially arbitrarily set. For example, the getter box may be mounted to the cathode panel and/or the anode panel before the cathode panel and the anode panel are joined to each other by using the joining member. Or, the getter box may be mounted to the cathode panel and/or the anode panel after the cathode panel and the anode panel are joined to each other by using the joining member. Or, the getter box may be mounted to the cathode panel and/or the anode panel in the junction with the joining of the cathode panel and the anode panel using the joining member. More specifically, the getter box may be mounted to the cathode panel, may be mounted to the anode panel, or may be mounted to the cathode panel and the anode panel. The frit glass or any suitable one of the above-mentioned low melting metal materials may be used in the mounting of the getter box to the cathode panel and/or the anode panel.

When the plane display device is used as the cold cathode field electron emission display device, a cold cathode field electron emission element (hereinafter referred to as "a field emission element" for short) constituting the electron emitting area is provided in the cathode panel. In this case, the field emission element includes:

(a) a strip-like cathode electrode which is formed on a supporting body and which extends in a first direction;

(b) an insulating layer formed on the strip-like cathode electrode and the supporting body;

(c) a strip-like gate electrode which is formed on the insulating electrode and which extends in a second direction different from the first direction;

(d) an opening portion which is formed in a portion, of the gate electrode and the insulating layer, located in an overlap area in which the cathode electrode and the gate electrode overlap each other, and which has a bottom portion through which the cathode electrode is exposed; and (e) an electron emitting portion provided on the cathode electrode exposed through the bottom portion of the opening portion.

The type of the field emission element is not especially limited. Thus, the spindt field emission element, and the flat electron emission element can be given as the field emission element. Here, the spindt field emission element is one in which the conical electron emitting portion is provided on the cathode electrode located in the bottom portion of the opening portion. Also, the flat field emission element is one in which the approximately flat electron emitting portion is provided on the cathode electrode located in the bottom portion of the opening portion.

In the cathode panel, it is preferable from a viewpoint of simplification of the construction of the cold cathode field electron emission display device that a projected image of the cathode electrode and a projected image of the gate electrode intersect each other perpendicularly that is, the first direction and the second direction intersect perpendicularly to each other. Also, the overlap area in which the cathode electrode and the gate electrode overlap each other corresponds to the electron emitting area. The electron emitting areas are arranged in a two-dimensional matrix in the effective area of the cathode panel. Also, one or plural field emission elements are provided in each of the electron emitting area.

In the cold cathode field electron emission display device, a strong electric field which is generated by applying voltages to the cathode electrode and the gate electrodes, respectively, is applied to the electron emitting portion, so that the electrons are emitted from the electron emitting portion in accordance with the quantum tunneling effect. Also, the anode panel attracts the electrons thus emitted through the anode electrode provided in the anode panel, so that these electrons collide with the phosphor layers. Also, the phosphor layers emit lights as a result of the collision of the electrons with the phosphor layers, and the lights thus emitted can be recognized in the form of an image.

In the cold cathode field electron emission display device, each of the cathode electrodes is connected to a cathode electrode controlling circuit, and each of the gate electrodes is connected to a gate electrode controlling circuit. Also, the anode electrode is connected to an anode electrode controlling circuit. Note that, these controlling circuits can be structured in the form of the well known circuits, respectively. In a phase of an actual operation, a voltage (anode voltage) $V_A$ which is applied from the anode electrode controlling circuit to the anode electrode is normally constant. For example, the anode voltage $V_A$ can be set in the range of 5 to 15 kV. Also, when a distance between the anode panel and the cathode panel is $d_0$ (where $0.5\ \text{mm} \leqq d_0 \leqq 10\ \text{mm}$), a value of $V_A/d_0$ (kV/mm) is desirably equal to or larger than 0.5 and equal to or smaller than 20, preferably, equal to or larger than 1 and equal to or smaller than 10, and more preferably equal to or larger than 4 and equal to or smaller than 8. In the phase of the actual operation of the cold cathode field electron emission display device, a voltage modulation system can be adopted, as a gradation control system, for a voltage $V_C$ which is applied to each of the cathode electrodes, and a voltage $V_G$ which is applied to each of the gate electrodes.

The field emission element can be manufactured by utilizing the following method, including the steps of:

(1) forming cathode electrodes on a supporting body;

(2) forming an insulating layer over the entire surface (on the supporting body and each of the cathode electrodes);

(3) forming gate electrodes in the insulating layer;

(4) forming an opening portion, in a portion of each of the gate electrodes and the insulating layer, in an overlap area between each of the cathode electrodes and each of the gate electrodes, and exposing the cathode electrodes through bottom portions of the respective opening portions; and (5) forming electron emitting portions on the cathode electrodes located in the bottom portions of the respective opening portions.

Or, the field emission element can be manufactured by utilizing the following method, including the steps of:

(1) forming cathode electrodes on a supporting body;

(2) forming electron emitting portions on the respective cathode electrodes;

(3) forming an insulating layer over the entire surface (on the supporting body and each of the electron emitting portions, or on the supporting body, each of the cathode electrodes and each of the electron emitting portions;

(4) forming gate electrodes on the insulating layer; and (5) forming an opening portion, in a portion of each of the gate electrodes and the insulating layer, in an overlap area between each of the cathode electrodes and each of the gate electrodes, and exposing the electron emitting portions through bottom portions of the respective opening portions.

The field emission element may be provided with a converging electrode. That is to say, for example, the field emission element may also be obtained in which an interlayer insulating layer is further provided on each of the gate electrodes and the insulating layer, and the converging electrode is provided on the interlayer insulating layer. Or, the field emission element may also be obtained in which the converging electrode is provided above each of the gate electrodes. Here, the converging electrode means one which converges an orbit of the electrons which are emitted through the opening portion and are directed to the anode electrode, thereby making it possible to enhance the luminance and to prevent the optical crosstalk caused between the pixels adjacent to each other. The converging electrode is especially effective in the so-called high voltage type cold cathode field electron emission display device in which a difference in potential between the anode electrode and the cathode electrode is on the order of several kilo volts or more, and a distance between the anode electrode and the cathode electrode is relatively long. A converging electrode controlling circuit applies a relatively negative voltage (for example, 0 V) to each of the converging electrodes. The converging electrodes are not necessarily, individually formed so as to surround the electron emitting portions or the electron emitting areas each of which is provided in the overlap area having the cathode electrode and the gate electrode overlapping each other. For example, the converging electrodes may extend along a predetermined arrangement direction of the electron emitting portions or the electron emitting areas. Or, one converging electrode may also be formed so as to surround all the electron emitting portions or electron emitting areas (that is, the converging electrode may also be formed into one sheet of thin structure which covers the entire effective area as the display area at the central portion performing the practical function as the cold cathode field electron emission display device). As a result, the influence of the common convergence effect can be exerted on a plurality of electron emitting portions or electron emitting areas.

In the case of the spindt type field emission element, at least one kind of material which is selected from the group consisting of molybdenum, a molybdenum alloy, tungsten, a tungsten alloy, titanium, a titanium alloy, niobium, a niobium alloy, tantalum, a tantalum alloy, chromium, a chromium alloy, and silicon (such as polysilicon or amorphous silicon) containing therein impurities can be given as the material of which the electron emitting portion is made. The electron emitting portion of the spindt type field emission element can be formed by utilizing any suitable one of the various physical vapor deposition methods (the PVD methods), or any suitable one of the various chemical vapor deposition methods (the CVD methods).

In the case of the flat type field emission element, a material having a smaller work function $\Phi$ than that of a material of which the cathode electrode is made is preferably used as a material of which the electron emitting portion is made. What material is selected for the electron emitting portion may be determined in accordance with the work function of the material of which the cathode electrode is made, the difference in potential between the gate electrode and the cathode electrode, the magnitude of the required emission electron current density, and the like. Or, a material having a larger secondary electron gain $\delta$ than that of the material of which the cathode electrode is made may be suitably selected as the material of which the electron emitting portion is made. In the case of the flat type field emission element, carbon, more specifically, an amorphous diamond or graphite, a carbon, nanotube structure (a carbon nanotube and/or a graphite nanofiber), ZnO whiskers, MgO whiskers, $SnO_2$ whiskers, MnO whiskers, $Y_2O_3$ whiskers, NiO whiskers, ITO (indium tin oxide) whiskers, $In_2O_3$ whiskers, and $Al_2O_3$ whiskers can be given for an especially preferable material of which the electron emitting portion is made. It should be noted that the material of which the electron emitting portion is made does not necessarily have a conductivity.

A metal such as aluminum (Al), tungsten (W), niobium (Nb), tantalum (Ta), molybdenum (Mo), chromium (Cr), copper (Cu), gold (Au), silver (Ag), titanium (Ti), nickel (Ni), cobalt (Co), zirconium (Zr), iron (Fe), platinum (Pt) or zinc (Zn); an alloy (for example, MoW) containing therein these metallic elements or a compound (for example, a nitride such as TiN, or a silicide such as $WSi_2$, $MoSi_2$, $TiSi_2$ or $TaSi_2$); a semiconductor such as silicon (Si); a carbon thin film such as a diamond; and a metallic oxide such as an ITO, an indium oxide or a zinc oxide can be exemplified for the material of which each of the cathode electrode, the gate electrode, and the converging electrode. In addition, a combination of a vacuum evaporation method such as an electron beam evaporation method or a hot filament evaporation method, a sputtering method, a CVD method or an ion plating method, and an etching method; various printing methods such as a screen printing method, an ink jet printing method and a metal mask printing method; a plating method (such as an electroplating method or a nonelectrolytic plating method); a liftoff method; a laser abrasion method; a sol-gel method, and the like can be given for methods of forming these electrodes. According to the various printing methods or plating methods, for example, the strip-like cathode electrode and a gate electrode can be directly formed.

An $SiO_2$ system material such as $SiO_2$, BPSG, PSG, BSG, AsSG, PbSG, SiON, a spin on glass (SOG), a low melting point glass or a glass paste; an SiN system material; and an insulating resin such as polyimide can be used independently or in a suitable combination thereof. The well known processes such as the CVD method, the coating method, the sputtering method and the various printing methods can be utilized for formation of the insulating layer and the interlayer insulating layer.

An arbitrary shape such as a circle, an ellipse, a rectangle, a polygon, a rounded rectangle or a rounded polygon can be selected as a planar shape (a shape when an opening portion is cut off with a virtual plane parallel with a surface of the supporting portion) of a first opening portion (an opening formed in each of the gate electrodes) or a second opening portion (an opening portion formed in the insulating layer). The first opening portion, for example, can be formed by utilizing an anisotropic etching method, an isotropic etching, or a combination thereof. Or, the first opening portion can be directly formed depending on the methods of forming the gate electrodes. The second opening portion, for example, can also be formed by utilizing the anisotropic etching method, the isotropic etching, or the combination thereof.

In the field emission element, although, depending on the construction of the field emission element, one electron emitting portion may exist within one opening portion, or a plurality of electron emitting portions may exist within one opening portion. Or, a plurality of first opening portions may be provided in each of the gate electrodes, one second opening portion may be provided in the insulating layer so as to communicate with each of the first opening portions, and one or plural electron emitting portions may exist within the one second opening portion provided in the insulating layer.

In the field emission element, a resistor film may be provided between each of the cathode electrodes and each of the electron emitting portions. The provision of the resistor film makes it possible to stabilize an operation of the field emitting element and to unify the electron emission characteristics. A carbon system material such as silicon carbide (SiC) or SiCN, a semiconductor material such as SiN or amorphous silicon, a high melting point metallic oxide such as a ruthenium oxide ($RuO_2$) or a tantalum oxide, and a high melting point metallic nitride such as a tantalum nitride can be exemplified for a material of which the resistor film is made. The sputtering method, the CVD method and the various printing methods can be exemplified as a method of forming the resistor film. An electrical resistance value per one electron emitting portion may be set approximately in the range of $1\times10^6$ to $1\times10^{11}\Omega$, and may be preferably set to several tens of giga ohms.

In the plane display device, (1) a structure in which the anode electrode is formed on the substrate, and the phosphor layers are formed on the anode electrode, and (2) a structure in which the phosphor layers are formed on the substrate, and the anode electrode is formed on the phosphor layers can be given as examples of the structures of the anode electrode and the phosphor layers. Note that, in the structure of (1), a so-called metal backing film which is electrically connected to the anode electrode may be formed on the phosphor layers. In addition, in the structure of (2), the metal backing film may be formed on the anode electrode.

The anode electrode may be structured totally in the form of one anode electrode, or may be structured in the form of a plurality of anode electrode units. In the case of the latter, one anode electrode unit and another anode electrode unit are preferably, electrically connected to each other through an anode electrode resistor layer. A carbon system material such as carbon, silicon carbide (SiC) or SiCN; an SiN system material; a high melting point metallic oxide such as a ruthenium oxide ($RuO_2$), a tantalum oxide, a chromium oxide or a titanium oxide; a high melting point metallic nitride such as a tantalum nitride; a semiconductor material such as amorphous silicon; and an ITO can be given for a material of which the anode electrode resistor layer is made. In addition, a combination of a plurality of films that a carbon thin film having a low resistance value is laminated on a resistor film made of SiC also makes it possible to realize a desired stable sheet resistance value. A sheet resistance value of $1\times10^{-1}$ to $1\times10^{10}\Omega/\square$, and preferably a sheet resistance value of $1\times10^3$ to $1\times10^8\Omega/\square$ can be exemplified as a sheet resistance value of the anode electrode resistor layer. The number, Q, of anode electrode units may be 2 or more. For example, when the total number of columns of the phosphor layers linearly arranged is q, q may be set as Q (Q=q), or q may be set as $k\cdot Q$ (k is an integral number of 2 or more, is preferably $10\leqq k\leqq 100$, and is more preferably $20\leqq k\leqq 50$). Or, q may be set as a number which is obtained by adding 1 to the number of spacers (or spacer groups) arranged at given intervals. Or, q may be set as a number which agrees with the number of pixels or the number of sub-pixels. Or, q may also be set as a number which is obtained by dividing the number of pixels or the number of sub-pixels by an arbitrary integral number. In addition, the sizes of the anode electrode units may be made identical to one another irrespective of the positions of the anode electrode units or may be made different from one another depending on the positions of the anode electrode units. Or, the anode electrode resistor layer may be generally formed on one anode electrode.

The anode electrode (including the anode electrode units) may be formed from a conductive material layer. For example, the various PVD methods such as the vacuum evaporation method such as the electron beam evaporation method or the hot filament evaporation method, the sputtering method, the ion plating method or the laser abrasion method; the various CVD methods; the various printing methods; the metal mask printing method; the liftoff method; the sol-gel method, and the like can be given as a method of forming the conductive material layer. That is to say, a conductive material layer made of a conductive material is formed, and this conductive material is patterned by utilizing a photolithography technique and an etching technique, thereby enabling the anode electrode to be formed. Or, a conductive material is formed through a mask or screen having a pattern of the anode electrode by utilizing the PVD method or any suitable one of the various printing methods, thereby enabling the anode electrode to be obtained. Note that, the anode electrode resistor layer can also be formed by utilizing the same method as that of the above case. That is to say, an anode electrode resistor layer may be formed from a resistor material, and the anode electrode resistor may be patterned by utilizing the photolithography technique and the etching technique. Or, the resistor material may be formed through a mask or screen having a pattern of the anode electrode resistor layer by utilizing the PVD method or any suitable one of the various printing methods, thereby enabling the anode electrode resistor layer to be obtained. An average thickness of $3\times10^{-8}$ to $5\times10^{-7}$ m (30 nm to 0.5 μm), and preferably an average thickness of $5\times10^{-8}$ to $3\times10^{-7}$ m (50 nm to 0.3 μm) can be exemplified as an average thickness of the anode electrode on the substrate (or above the substrate) (an average thickness of the anode electrode on a top surface of each of the partition walls when the partition walls are provided as will be described later).

A metal such as molybdenum (Mo), aluminum (Al), chromium (Cr), tungsten (W), niobium (Nb), tantalum (Ta), gold (Au), silver (Ag), titanium (Ti), cobalt (Co), zirconium (Zr), iron (Fe), platinum (Pt) or zinc (Zn); an alloy or compound containing therein corresponding one or ones of these metallic elements (for example, a nitride such as TiN, or silicide such as $WSi_2$, $MoSi_2$, $TiSi_2$ or $TaSi_2$); a semiconductor such as silicon (Si); a carbon thin film such as a diamond; and a conductive metallic oxide such as an ITO, an indium oxide or a zinc oxide can be exemplified for a material of which the anode electrode is made. Here, when the anode electrode resistor layer is formed, the anode electrode is preferably made of a conductive material which does not change a resistance value of the anode electrode resistor layer. For example, when the anode electrode resistor layer is made of silicon carbide (SiC), the anode electrode is preferably made of molybdenum (Mo).

Each of the phosphor layers may be formed from phosphor particles having a single color, or may be formed from phosphor particles having the three primary colors. The phosphor layers, for example, are arranged in dots. More specifically, when the plane display device performs the color display, a delta arrangement, a stripe arrangement, a diagonal arrangement, or a rectangle arrangement can be given as a disposition or arrangement of the phosphor layers. That is to say, one column of the phosphor layers linearly arranged may be constituted by a column the whole of which is occupied by red emission phosphor layers, a column the whole of which is occupied by green emission phosphor layers, and a column the whole of which is occupied by blue emission phosphor layers. Or, one column of the phosphor layers linearly arranged may be constituted by a column in which the red emission phosphor layer, the green emission phosphor layer, and the blue emission phosphor layer are arranged in order.

Here, a phosphor area which generates one luminescent spot on the anode panel is defined as the phosphor layer. In addition, one pixel is constituted by a set of one red emission phosphor layer, one green emission phosphor layer, and one blue emission phosphor layer. Also, one sub-pixel is constituted by one phosphor layer (that is, one red emission phosphor layer, one green emission phosphor layer, or one blue emission phosphor layer). Note that, the space defined between the phosphor layers adjacent to each other may be filled with the light absorbing layer (black matrix) provided for enhancement of a contrast.

The phosphor layers can be formed by utilizing the following method. That is to say, a luminescent crystalline particle composition is used which is prepared from luminescent crystalline particles. For example, a red photosensitive luminescent crystalline particle composition (red emission phosphor slurry) is coated over the entire surface, is exposed, and is developed, thereby forming a red emission phosphor layer. Next, a green photosensitive luminescent crystalline particle composition (green emission phosphor slurry) is coated over the entire surface, is exposed, and is developed, thereby forming a green emission phosphor layer. Moreover, a blue photosensitive luminescent crystalline particle composition (blue emission phosphor slurry) is coated over the entire surface, is exposed, and is developed, thereby forming a blue emission phosphor layer. Or, the red emission phosphor slurry, the green emission phosphor slurry, and the blue emission phosphor slurry may be coated in order. After that, these phosphor slurries may be exposed and be developed, thereby forming the phosphor layers. Or, the phosphor layers may be formed by utilizing the screen printing method, the ink jet printing method, the float coating method, the sedimentation coating method, the phosphor film transferring method or the like. Although an average thickness of each of the phosphor layers on the substrate is not especially limited, desirably, it is in the range of 3 to 20 μm, and preferably in the range of 5 to 10 μm. The phosphor materials of which the luminescent crystalline particles are made, respectively, can be suitably selected from the phosphor materials which are known in the past. In the case of the color display, the phosphor materials which have the color purities close to the three primary colors prescribed in NTSC, which have the white balance when the three primary colors are mixed with one another, and which have persistence times, so that the persistence times of the three primary colors becomes approximately equal to one another are preferably combined with one another.

The light absorbing layer for absorbing the lights from the phosphor layers is preferably formed between the adjacent phosphor layers, or between each of the partition walls and the substrate from a viewpoint of enhancement of a contrast of a displayed image. Here, the light absorbing layer functions as the so-called black matrix. A material which absorbs a 90% or more light from the phosphor layer is preferably selected as the material of which the light absorbing layer is made. Materials such as carbon, a metallic thin film (for example, made of chromium, nickel, aluminum or molybdenum, or an alloy thereof), a metallic oxide (such as a chromium oxide), a metallic nitride (such as chromium nitride), a heat-resisting organic resin, a glass paste, or a glass paste containing therein conductive particles such as a black pigment or silver particles can be given for a material of which the light absorbing layer is made. More specifically, a photosensitive polyimide resin, a chromium oxide, or a lamination film of a chromium oxide/a chromium film can be exemplified. Here, in the lamination film of a chromium oxide/a chromium film, the chromium film contacts a substrate. The light absorbing layer, for example, can be formed by utilizing a method suitably selected depending on a used material. Such a method can be exemplified by a combination of the vacuum evaporation method or the sputtering method, and the etching method, a combination of the vacuum evaporation method or the sputtering method, and the spin coating method and the liftoff method, the various printing methods, or the photolithography technique.

The electrons recoiled from the phosphor layer, or the secondary electrons emitted from the phosphor layer are made incident to other phosphor layers, thereby generating the so-called optical crosstalk (color turbidity). In order to prevent the optical crosstalk from being generated, a partition wall is preferably provided.

The screen printing method, a dry film method, a photosensitizing method, a casting method, or a sandblast forming method can be exemplified as a method of forming the partition wall. Here, the screen printing method is as follows. That is to say, an opening is formed in a portion of a screen corresponding to a portion in which the partition wall is intended to be formed. A partition wall forming material on the screen is made to pass through the opening by using a squeegee to form the partition wall forming material on a substrate. After that, such a partition wall forming material is fired. The dry film method is as follows. That is to say, a photosensitive film is laminated on a substrate. A portion of the photosensitive film in which a partition wall is intended to be formed is removed through the exposure and the development. After that, an opening formed through the removal is filled with a partition wall forming material, and the partition wall forming material is then fired. In this case, the photosensitive film is burned and is removed through the firing, so that the partition wall forming material filled in the opening is left to become the partition wall. The photosensitizing method is as follows. That is, a partition wall forming material layer having a photosensitive property is formed on a substrate. After the partition wall forming material layer is patterned through the exposure and the development, the resulting partition wall forming material layer is fired (cured). The casting method (embossing forming method) is as follows. That is, a partition wall forming material layer made of an organic material or an inorganic material formed in the form of a paste is pushed out from a cast onto a substrate, thereby forming the partition wall forming material layer. After that, such a partition wall forming material layer is fired. Also, the sandblast forming method is as follows. That is, for example, a partition wall forming material layer is formed on a substrate by utilizing the screen printing or metal mask printing method, or by using a roll coater, a doctor blade, a nozzle ejection coater or the like, and is then dried. After that, a portion of the partition wall forming material layer in which the partition wall is intended to be formed is covered with a mask layer. Next, an exposed portion of the partition wall forming material is removed by utilizing the sandblast method. After formation of the partition wall, the partition wall may be polished, thereby flattening its top surface.

A rectangular shape, a rectangular shape, a circular shape, an elliptical shape, an oval shape, a triangular shape, a polygonal shape having five or more angles, a rounded triangular shape, a rounded rectangular shape, a rounded polygon, and the like can be exemplified as a planar shape (which corresponds to an inner border line, of a projected image, on a side surface of the partition wall, and which is a sort of opening area) of a portion surrounding the phosphor layers in the partition wall. These planar shapes (planar shapes of opening areas) are arranged in two-dimensional matrix, thereby forming lattice-like partition walls. The arrangement of the planar shapes in a two-dimensional matrix, for example, may be made in the form of a curb style or may be made in the form of a zigzag style.

For example, a photosensitive polyimide resin, a lead glass colored with black from a metallic oxide such as a cobalt oxide, $SiO_2$, or a low melting point glass paste can be exemplified as the partition wall forming material. A protective layer (for example, made of $SiO_2$, SiON or AlN) for protecting a gas from being discharged from the partition wall as a result of collision of an electron beam with the partition wall may be formed on a surface (including the top surface and the side surface) of the partition wall.

The space defined between the cathode panel and the anode panel is kept at a high vacuum. Therefore, the plane display device is damaged by the atmosphere pressure unless spacers each being made of a high resistance material such as a ceramic material or a glass are arranged between the cathode panel and the anode panel. Each of the spacers, for example, may be made of ceramics or a glass. When each of the spacers is made of the ceramics, an aluminum silicate compound such as mullite, an aluminum oxide such as an alumina, barium titanate, lead zirconate titanate, zirconia (zirconium oxide), cordiorite, barium borosilicate, iron silicate, and glass ceramic materials, and a material which is obtained by adding a titanium oxide, a chromium oxide, a magnesium oxide, an iron oxide, a vanadium oxide or a nickel oxide to any suitable one of these materials can be exemplified as the ceramics for the spacer. Or, any suitable one of materials described in JP-A-2003-524280 can also be used. In this case, a so-called green sheet is formed, and is then fired. Also, such a fired green sheet product is cut off into pieces, thereby enabling the spacer to be manufactured. In addition, a high strain point glass, a low-alkaline glass, an alkali-free glass, a soda glass ($Na_2O.CaO.SiO_2$), a borosilicate glass ($Na_2O.B_2O_3SiO_2$), a forsterite ($2MgO.SiO_2$), and a lead glass ($Na_2O.PbO.SiO_2$) can be exemplified for the glass material of which each of the spacers is made. The spacer, for example, may be fixed by being held between the partition walls provided in the anode panel. Or, for example, a spacer holding portion may be formed in the anode panel and/or the cathode panel, and the spacers may be fixed by using the spacer holding portion. Or, the spacers can also be fixedly fastened to the cathode panel and/or the anode panel by using the frit glass, the low melting point metal, or the like.

An antistatic film may be formed on a surface of each of the spacers. A material of which the antistatic film is made preferably has a secondary electron emission coefficient close to 1. For example, a half metal such as graphite, an oxide, a boride, a carbide, a sulfide, a nitride and the like can be given for the material of which the antistatic film is made. More specifically, for example, the half metal such as graphite, a compound, containing therein a half metal element, such as $MoSe_x$, the oxide such as $CrO_x$, $NdO_x$, $La_xBa_{2-x}CuO_4$, $La_xBa_{2-x}CuO_4$, or $La_xY_{1-x}CrO_3$, the boride such as $AlB_x$ or $TiB_X$, the carbide such as SiC, the sulfide such as $MoS_x$ or $WS_x$, the nitride such as BN, TiN or AlN, and the like can be given for the material of which the antistatic film is made. The materials or the like described in JP-A-2004-500688 can also be used. The antistatic film may be made of one kind of material or made of a plurality kind of materials, or may have a single layer structure or a multilayer structure. The antistatic film can be formed by utilizing the well known method such as the sputtering method, the vacuum evaporation method, or the CVD method.

In the first or second embodiment of the present invention, the cold cathode field electron emission element, the metal/insulating film/metal type element (MIM element), and the surface-conduction electron emission element can be given as the electron emitting element constituting the electron emitting area. In addition, the plane display device (cold cathode field electron emission display device), the plane display device having the MIM elements incorporated therein, and the plane display device having the surface-conduction electron emission elements incorporated therein can be given as the plane display device.

In the plane display device according to Embodiment 1 of the present invention, the exhaust tube and the anode electrode are electrically connected to each other through the elastic member disposed within the space. Also, the predetermined voltage is applied to the anode electrode through the exhaust tube and the elastic member. In addition, in the plane display device according to the second embodiment of the present invention, one end portion of the exhaust tube directly contacts the anode electrode. Also, the predetermined voltage is applied to the anode electrode through the exhaust tube. Consequently, it is possible to simplify the mechanism for applying the predetermined voltage to the anode electrode. Also, it is possible to simplify the processes for manufacturing the plane display device. In addition, unlike the related art, it is unnecessary to provide the member which extends completely through the exhaust tube to protrude to the outside of the display device. Thus, a problem is prevented from being caused in holding of the air leakage efficiency of the exhaust tube. As a result, the space can be readily and reliably exhausted through the exhaust tube.

DETAILED DESCRIPTION OF THE PREFERRED EMBODIMENTS

Preferred embodiments of the present invention will be described in detail hereinafter with reference to the accompanying drawings.

Embodiment 1

Figure 1:
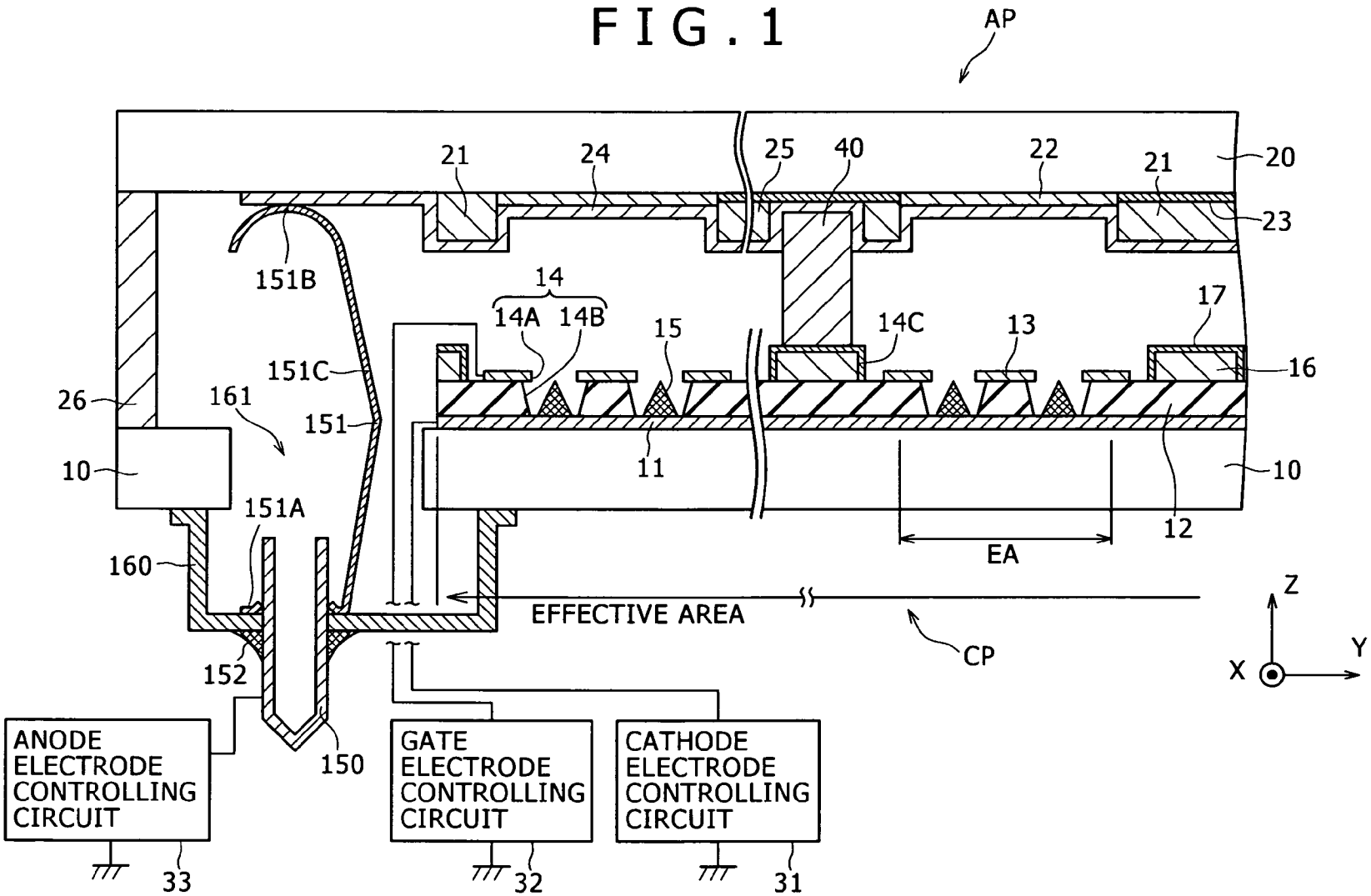
FIG. 1 is a conceptual partial end view of a plane display device according to Embodiment 1 of the present invention.
Figure 9:
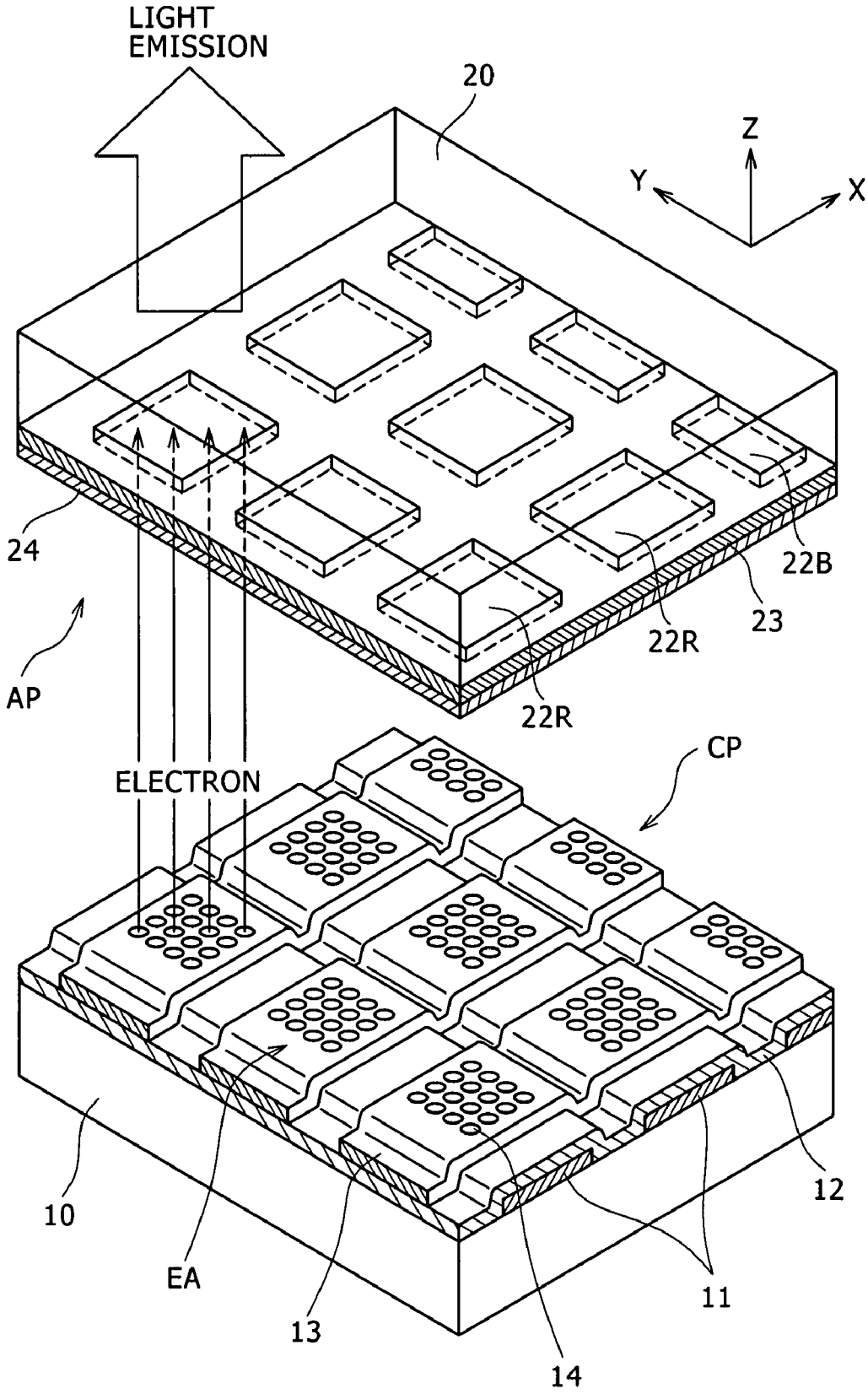
FIG. 9 is a partial schematic exploded perspective view of a cathode panel and an anode panel when the cathode panel and the anode panel are exploded.

FIG. 1 is a conceptual partial end view of a plane display device according to Embodiment 1 of the present invention. A plane display device according to Embodiment 1 or Embodiment 2 which will be described later of the present invention is a cold cathode field electron emission display device (hereinafter referred to as "a display device" for short) similarly to the plane display device which was described in the paragraph of BACKGROUND OF THE INVENTION. Here, a schematic partial exploded perspective view of a cathode panel CP and an anode panel AP when the cathode panel CP and the anode panel AP in the display device according to Embodiment 1 or Embodiment 2 which will be described later of the present invention are exploded is similar to that shown in FIG. 9.

The display device according to Embodiment 1 or Embodiment 2 which will be described later of the present invention is one in which the cathode panel CP, and the anode panel AP are joined to each other in their peripheral portions, and a space defined between the cathode panel CP and the anode panel AP is kept at a vacuum. Here, the cathode panel CP has a plurality of electron emitting areas EA provided therein. Also, the anode panel AP has phosphor layers 22 and an anode electrode 24 provided therein.

Also, the display device of Embodiment 1 includes:

(A) an exhaust tube 150 which is made of a conductive material (more specifically, a nickel alloy in Embodiment 1), one end portion of which communicates with the space, and the other end portion of which is located outside the display device; and (B) an elastic member 151 made of a conductive material (more specifically, a stainless steel in Embodiment 1).

Here, in Embodiment 1, the exhaust tube 150 and the anode electrode 24 are electrically connected to each other through the elastic member 151 disposed within the space. A predetermined voltage (an anode voltage $V_A$) is applied to the anode electrode 24 through the exhaust tube 150 and the elastic member 151.

Figure 2:
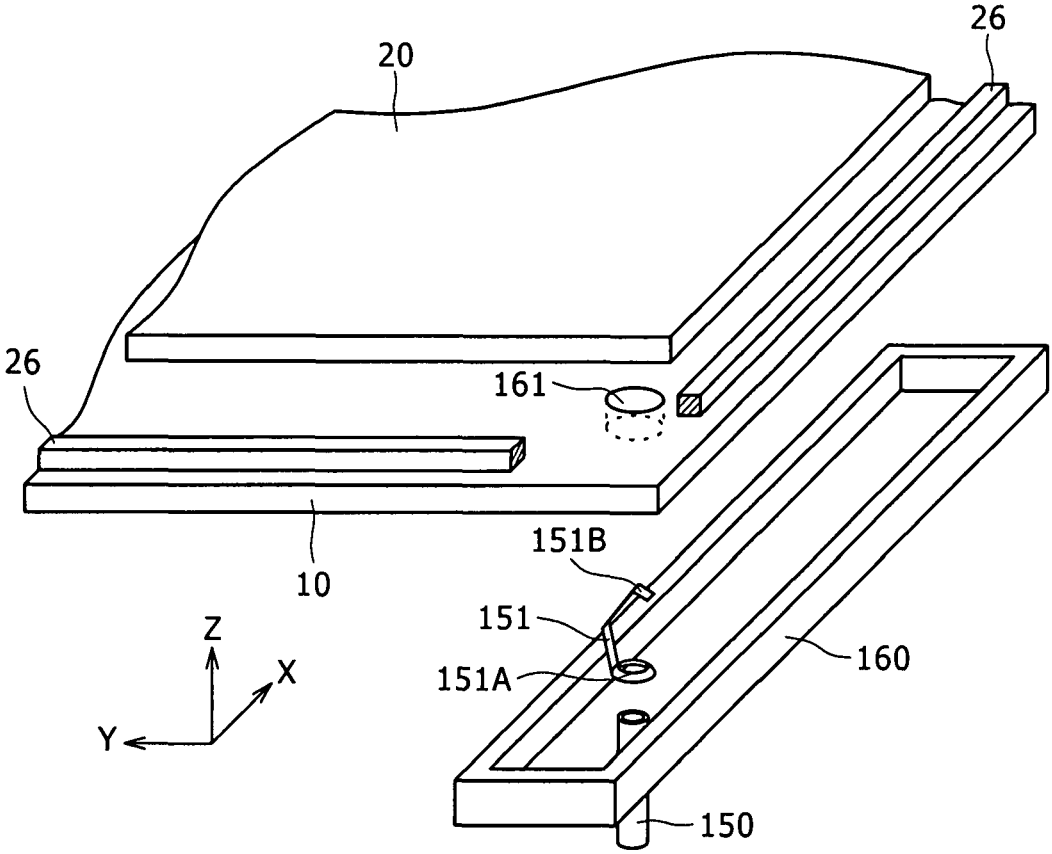
FIG. 2 is a schematic exploded perspective view when a cathode panel, an anode panel, a getter box and the like are exploded.

FIG. 2 shows a schematic exploded perspective view when the cathode panel CP, the anode panel AP, a getter box 160 and the like are exploded. In the display device of Embodiment 1, the getter box 160 which communicates with the space is mounted to the cathode panel CP. More specifically, one or plural through holes (one though hole in FIG. 2) 161 are formed in the cathode panel CP. The getter box 160 made of a ceramic material is bonded to a supporting body 10 by using a frit glass (not shown) so as to close up the through hole 161 from the outside of the cathode panel CP. Also, the exhaust tube 150 is mounted to the getter box 160 by using a frit glass 152. The exhaust tube 150 is disposed so that one end portion thereof protrudes from a bottom portion of the getter box 160 to the anode panel side. Thus, the exhaust tube 150 communicates with the space defined between the cathode panel CP and the anode panel AP. On the other hand, the other end portion of the exhaust tube 150 is located outside the display device, is bonded to the getter box 160 by the application of a pressure, and is sealed. Note that, a getter (not shown) is accommodated in the getter box 160.

More specifically, as shown in FIGS. 1 and 2, the elastic member 151 includes an approximately circular engagement portion 151A, an arcuate portion 151B, and a connection portion 151C through which the approximately circular engagement portion 151A and the arcuate portion 151B are connected to each other. Also, one end of the elastic member 151 abuts against the anode electrode 24, and the other end thereof is fixedly fastened to the exhaust tube 150. More specifically, a portion, of the exhaust tube 150, which protrudes from a bottom portion of the getter box 160 is inserted into the approximately circular engagement portion 151A. In addition, the arcuate portion 151B constituting the elastic member 151 is disposed so as to abut against (is pressed to) the anode electrode 24. As a result, the exhaust tube 150 and the anode electrode 24 are electrically and reliably connected to each other through the elastic member 151.

Figure 4:
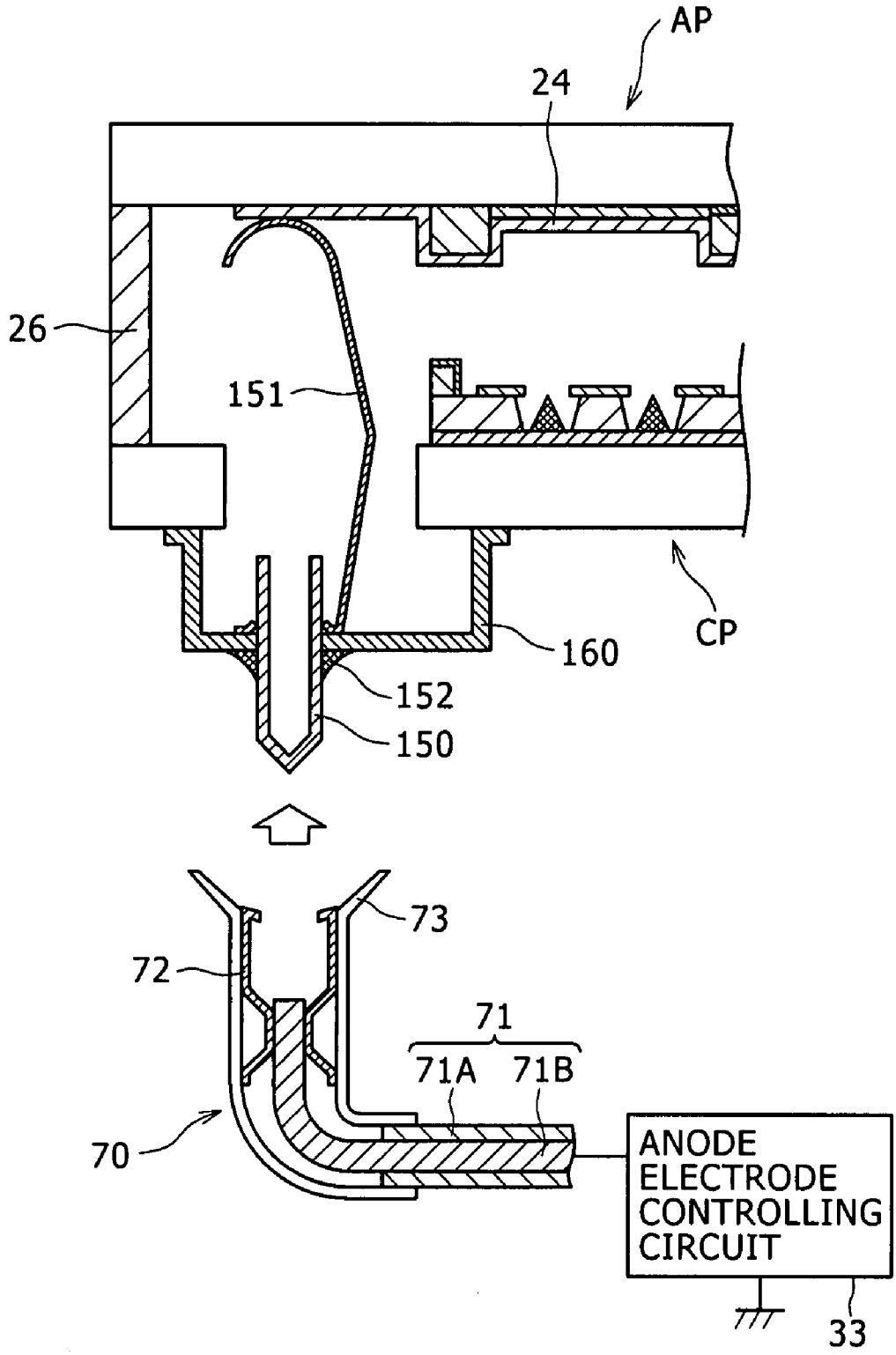
FIG. 4 is a schematic constructional view of a connection portion between an anode electrode controlling circuit and an exhaust tube.

As shown in FIG. 1, an anode electrode controlling circuit 33 applies a predetermined voltage to the anode electrode 24 through the exhaust tube 150 and the elastic member 151. FIG. 4 shows a schematic constructional view of a connection portion 70 between the anode electrode controlling circuit 33 and the exhaust tube 150. The connection portion 70 includes a cable 71 consisting of a covering 71A and a core wire 71B, a clip 72 made of a metal and connected to the core wire 71B and an insulating portion 73 which surrounds an outer circumference of the clip 72. According to this construction, the portion to which the anode voltage is applied is prevented from being exposed to the outside in a state in which the connection portion 70 is mounted to the exhaust tube 150.

As shown in FIG. 1, in the cathode panel CP of the display device of Embodiment 1, each of the cathode electrodes 11 has a strip-like shape extending in a first direction (in a Y direction), and each of the gate electrodes 13 also has a strip-like shape extending in a second direction (in an X direction) different from the first direction. Each of the cathode electrodes 11 and each of the gate electrodes 13 are formed in strip shapes, respectively, in directions along which their projected images intersect perpendicularly each other. Overlap areas in which the strip-like cathode electrodes 11 and the strip-like gate electrodes 13 overlap each other are electron emitting areas EA, respectively. A plurality of field emission elements are provided in one electron emitting area EA corresponding to one sub-pixel. Also, the electron emitting areas EA each corresponding to one sub-pixel are arranged in a two-dimensional matrix within an effective area of the cathode panel CP.

An interlayer insulating layer 16 is formed on an insulating layer 12 and each of converging electrodes 17 is provided on the interlayer insulating layer 16. The converging electrodes can exert a common converging effect on a plurality of field emission elements. A third opening portion 14C communicating with a first opening portion 14A is formed in the interlayer insulating layer 16.

In Embodiment 1, the field emission element constituting the electron emitting area EA is constituted by a spindt field emission element. Here, the spindt field emission element includes:

(a) the cathode electrodes 11 formed on the supporting body 10;

(b) the insulating layer 12 formed on the supporting body 10 and each of the cathode electrodes 11;

(c) the gate electrodes 13 each of which is formed on the insulating layer 12;

(d) the opening portion (14) formed in each of the gate electrodes 13 and the insulating layer 12 (including the first opening portion 14A formed in each of the gate electrodes 13, and the second opening portion 14B formed in the insulating layer 12); and (e) the conical electron emitting portion 15 formed on the cathode electrode 11 located in the bottom portion of the opening portion 14.

In Embodiment 1, the anode panel AP includes the substrate 20, the phosphor layers 22 formed on the substrate 20, and the anode electrode 24 covering the phosphor layers 22. More specifically, the anode panel AP includes the substrate 20, the phosphor layers 22 (red emission phosphor layers 22R, green emission phosphor layers 22G, and blue emission phosphor layers 22B), and the anode electrode 24 formed over the phosphor layer 22. Here, the phosphor layers 22 are made from a large number of phosphor particles, and are formed between the partition walls 21 formed on the substrate 20. The anode electrode 24 has one sheet-like shape so as to cover the effective area, and is formed so as to cover the partition walls 21 and the phosphor layers 22. A light absorbing layer (black matrix) 23 is formed between the adjacent phosphor layers 22 and also between each of the partition walls 21 and the substrate 20 in order to prevent the color turbidity and the optical crosstalk of a displayed image from being generated. Also, a space defined between the cathode panel CP and the anode panel AP is kept at a vacuum (for example, having a pressure of $10^{-3}$ Pa or less).

Figure 3:
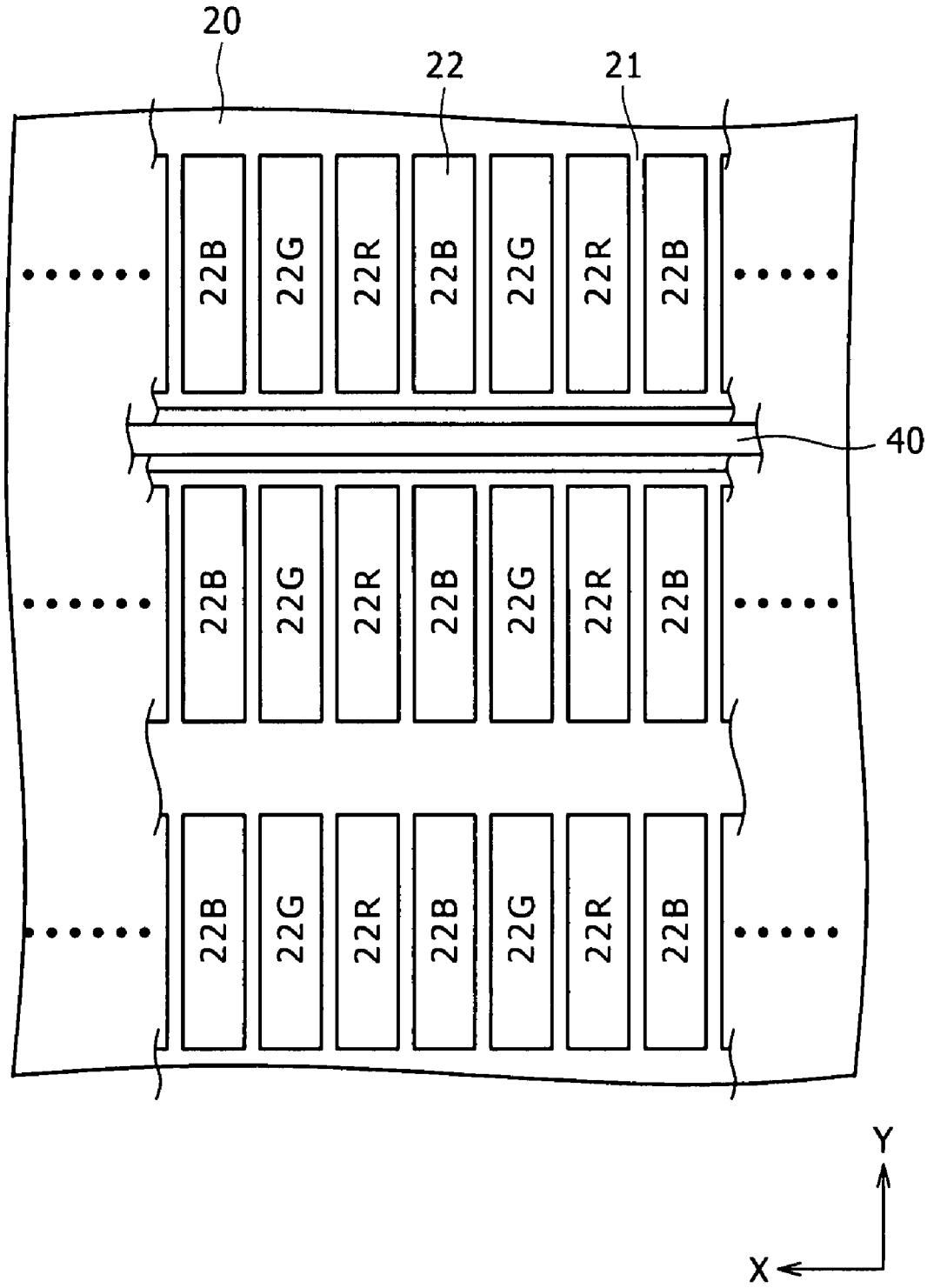
FIG. 3 is a schematic plan view explaining an arrangement state of partition walls, spacers, and phosphor layers in the plane display device according to Embodiment 1 of the present invention.

FIG. 3 is a schematic plan view explaining the arrangement state of the partition walls 21, the spacers 40 and the phosphor layers 22 in the display device of Embodiment 1. An illustration of the anode electrode 24 is emitted here for the sake of simplicity in FIG. 3. The planar shape of the partition walls 21 is a lattice shape (rub shape), that is, is a shape surrounding all sides of each of the phosphor layers 22, for example, having approximately a rectangle as a planar shape, and corresponding to one sub-pixel. A part of the partition walls 21 functions as a spacer holding portion 25 as well for holding the spacers 40.

One sub-pixel includes the electron emitting area EA on the cathode panel side, and the phosphor layer 22, on the anode panel side, facing a group of field emission elements. The pixels, for example, are arranged on the order of several hundreds of thousands to several millions in the effective area. Note that, in the color display device, one pixel includes a set of red emission sub-pixel, green emission sub-pixel, and blue emission sub-pixel.

In Embodiment 1, the cathode electrode 11 is connected to a cathode electrode controlling circuit 31. Each of the gate electrodes 13 is connected to a gate electrode controlling circuit 32. Also, each of the converging electrodes 7 is connected to a converging electrode controlling circuit (not shown). As described above, the anode electrode 24 is connected to the anode electrode controlling circuit 33 through the elastic member 151 and the exhaust tube 150. These controlling circuits can be structured in the form of the well known circuits, respectively. In the phase of the actual operation of the display device, an anode voltage $V_A$ which is applied from the anode electrode controlling circuit 33 to the anode electrode 24 is normally constant. For example, the anode voltage $V_A$ can be set in the range of 5 to 15 kV, more specifically, for example, can be set to 9 kV (for example, $d_0$=2.0 mm in this case). On the other hand, in the phase of the actual operation of the display device, any of the following methods may be adopted for a voltage $V_C$ applied to each of the cathode electrodes 11, and a voltage $V_G$ applied to each of the gate electrodes 13:

(1) a method in which the voltage $V_C$ applied to each of the cathode electrodes 11 is made constant, and the voltage $V_G$ applied to each of the gate electrodes 13 is made variable;

(2) a method in which the voltage $V_C$ applied to each of the cathode electrodes 11 is made variable, and the voltage $V_G$ applied to each of the gate electrodes 13 is made constant; and (3) a method in which the voltage $V_C$ applied to each of the cathode electrodes 11 is made variable, and the voltage $V_G$ applied to each of the gate electrodes 13 is also made variable.

In the phase of the actual operation of the display device, the cathode electrode controlling circuit 31 applies the relatively negative voltage ($V_C$) to each of the cathode electrodes 11. The gate voltage controlling circuit 32 applies the relatively positive voltage ($V_G$) to each of the gate electrodes 13. The converging electrode controlling circuit, for example, applies 0 V to each of the converging electrodes 17. Also, the anode electrode controlling circuit 33 applies the higher positive voltage (the anode voltage $V_A$) than that applied to each of the gate electrodes to the anode electrode 11. When an image is intended to be displayed on such a display device, for example, the cathode electrode controlling circuit 31 inputs a scanning signal to each of the cathode electrodes 11, and the gate electrode controlling circuit 32 inputs a video signal corresponding to the image to each of the gate electrodes 13. It should be noted that the cathode electrode controlling circuit 31 may input a video signal to each of the cathode electrodes 11, and the gate electrode controlling circuit 32 may input a scanning signal to each of the gate electrodes 13. The electrons are emitted from the electron emitting portion 15 in accordance with the quantum tunneling effect caused by the electric field which is generated when a suitable voltage is applied across the corresponding ones of the cathode electrodes 11 and the corresponding ones of the gate electrodes 13. The anode electrode 24 attracts these electrons. Then, these electrons penetrate through the anode electrode 24 to collide with the corresponding ones of the phosphor layers 22. As a result, the corresponding ones of the phosphor layers 22 are excited to emit lights, respectively, thereby enabling a desired image to be obtained on a screen of the display device. In other words, the operation of the display device is basically controlled in accordance with the gate voltage $V_G$ applied to each of the gate electrodes 13, and the cathode voltage $V_C$ applied to each of the cathode electrodes 11.

A detailed description will be given hereinafter with respect to a method of manufacturing the display device according to Embodiment 1 of the present invention.

[Process-100]

Firstly, the getter box 160, the cathode panel CP, and the anode panel AP are prepared. In addition, the spacers 40 are also prepared. Here, the exhaust tube 150 and the elastic member 151 are mounted in a predetermined state to the getter box 160. A plurality of field emission elements each constituting the electron emitting area for emitting the electrons are formed on the supporting body 10 in the cathode panel CP. Also, the phosphor layers 22 with which the electrons emitted from the electron emitting areas collide, respectively, and the anode electrode 24 are formed on the substrate 20 in the anode panel AP.

[Process-110]

The getter box 160 is bonded to the supporting body 10 constituting the cathode panel CP by using a frit glass or the like.

[Process-120]

Also, the display device is assembled. More specifically, the spacers 40 are mounted to the spacer holding portion 25 of the anode panel AP, and the joining member 26 is disposed in a non-effective area of the anode panel AP. Then, the anode panel AP and the cathode panel CP are assembled so that the phosphor layers 22 and the electron emitting areas ED face each other, respectively, and the arcuate portion 151B constituting the elastic member 151 abuts against (is pressed to) the anode electrode 24. Each of the top surface and the bottom surface of the joining member 26 is coated with the frit glass. Here, this frit glass was temporarily fired at 350° C. for 20 minutes.

[Process-130]

After that, the entire assembly body is brought in a firing furnace, and is then subjected to heating processing within the firing furnace, thereby formally firing the entire assembly body at a temperature of about 400° C. for about 30 minutes. A pressure of the ambient atmosphere in the phase of the firing may be either a normal pressure or a reduced pressure. In addition, a gas constituting the ambient atmosphere may be either air or an inactive gas containing therein a nitrogen gas or a gas belonging to a zero group in the periodic series (for example, an Ar gas).

[Process-140]

After that, the entire assembly body is carried out from the firing furnace. The space defined among the cathode panel CP, the anode panel AP, and the joining member 26 is exhausted through the exhaust tube 150. Then, at a time point when the pressure in the space reaches about $10^{-4}$ Pa, the exhaust tube 150 is bonded to the getter box 160 by the application of a pressure to be sealed. Note that, it is suitable that the entire display device is temporarily heated and the temperature thereof is then caused to drop before performing the sealing because the residual gas can be discharged to the space and can be removed to the outside of the space through the exhaust process. The space defined among the cathode panel CP, the anode panel AP, and the joining member 26 can be kept at the vacuum in the manner as described above. After that, wirings are connected to necessary external circuits, thereby completing the display device of Embodiment 1.

Figure 5A:
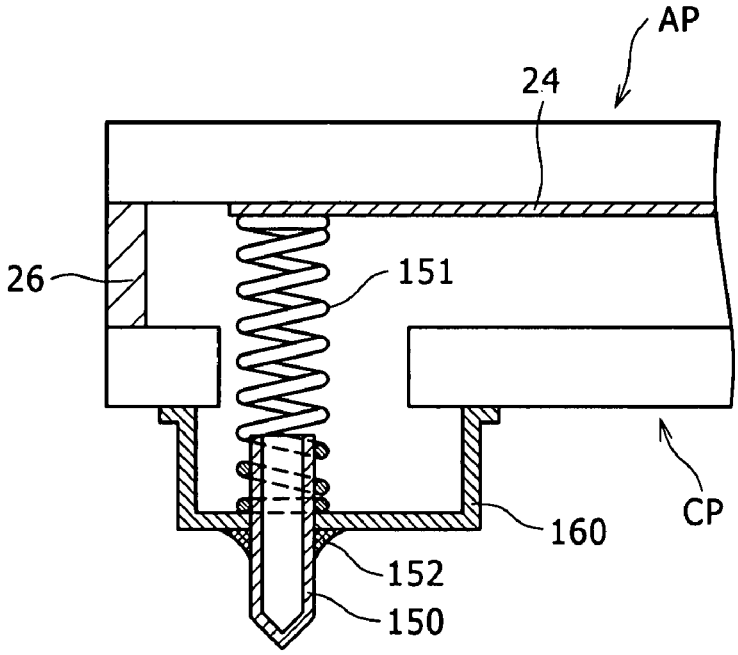
FIGS. 5A and 5B are respectively conceptual partial end views of a change and another change of Embodiment 1 which are different in construction of an elastic member from each other.
Figure 5B:
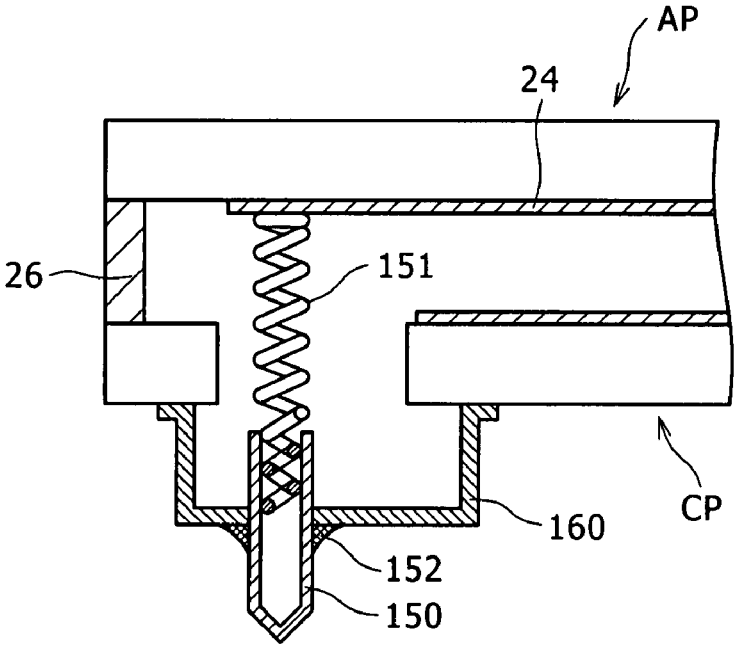
Figure 6A:
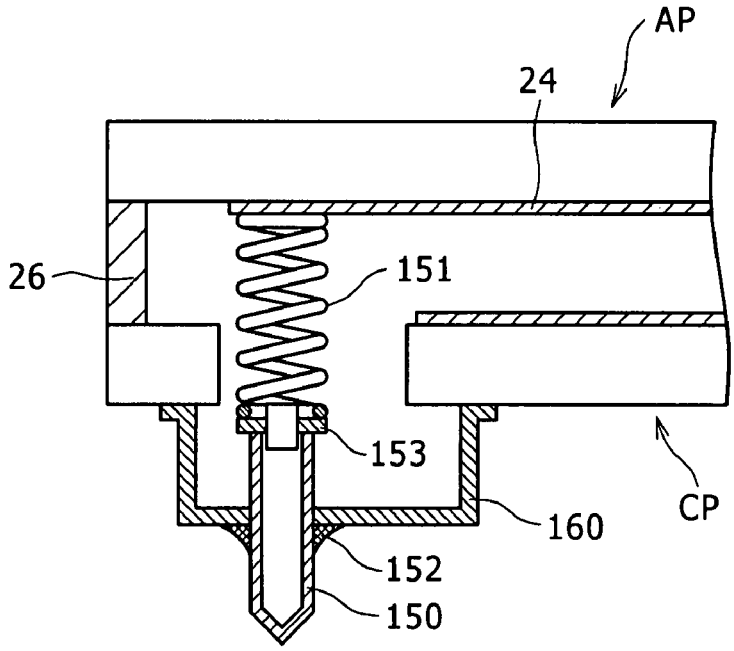
FIGS. 6A and 6B are respectively conceptual partial end views of still another change and yet another change of Embodiment 1 which are different in construction of an elastic member from each other.
Figure 6B:
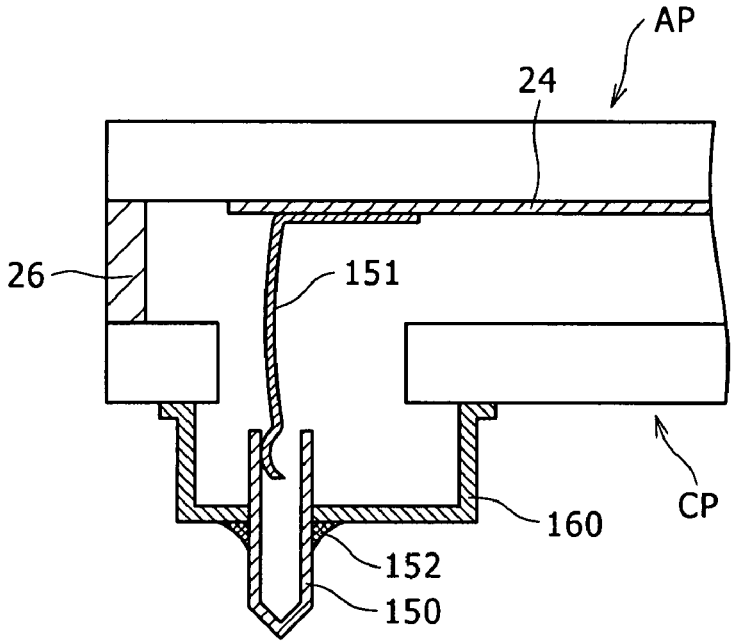

FIGS. 5A and 5B respectively show conceptual partial end views of a change and another change of the elastic member 151 of the display device shown in FIG. 1. FIGS. 6A and 6B respectively show conceptual partial end views of still another change and yet another change of the elastic member 151 of the display device shown in FIG. 1. Here, illustrations of the spacers 40, and the phosphor layers 22, the light absorbing layer 23, the partition walls 21, and the like constituting the anode panel AP are omitted in these figures for the sake of simplicity. In addition, illustrations of the insulating layer 12, the gate electrodes 13, and the like constituting the cathode panel CP are also omitted in these figures for the sake of simplicity.

In each of the changes shown in FIGS. 5A and 5B, and FIGS. 6A and 6B, respectively, the elastic member 151 is constituted by a coil spring made of a stainless steel. Also, in the change shown in FIG. 5A, the other end of the elastic member 151 is fixed so as to be engaged with the outer circumference of the exhaust tube 150. In addition, in the change shown in FIG. 5B, the other end of the elastic member 151 is fixed so as to be engaged with an inner wall of the exhaust tube 150. Moreover, in the change shown in FIG. 6A, a washer 153 including an annular-shaped protrusion portion is mounted to the end portion of the exhaust tube 150. The other end of the elastic member 151 is fixedly fastened to the washer 153. Here, in each of the changes described above, the elastic member 151 is disposed so that one end thereof abuts against or is pressed to the anode electrode 24.

In the change shown in FIG. 6B, the elastic member 151 is constituted by a plate made of a stainless steel similarly to that in Embodiment 1. Also, the other end of the elastic member 151 is fixed so as to contact the anode electrode 24. In addition, one end portion of the elastic member 151 is disposed so as to abut against the inner wall of the exhaust tube 150. Note that, one end portion of the elastic member 151 may be disposed so as to abut against an outer wall of the exhaust tube 150.

Embodiment 2

Figure 7:
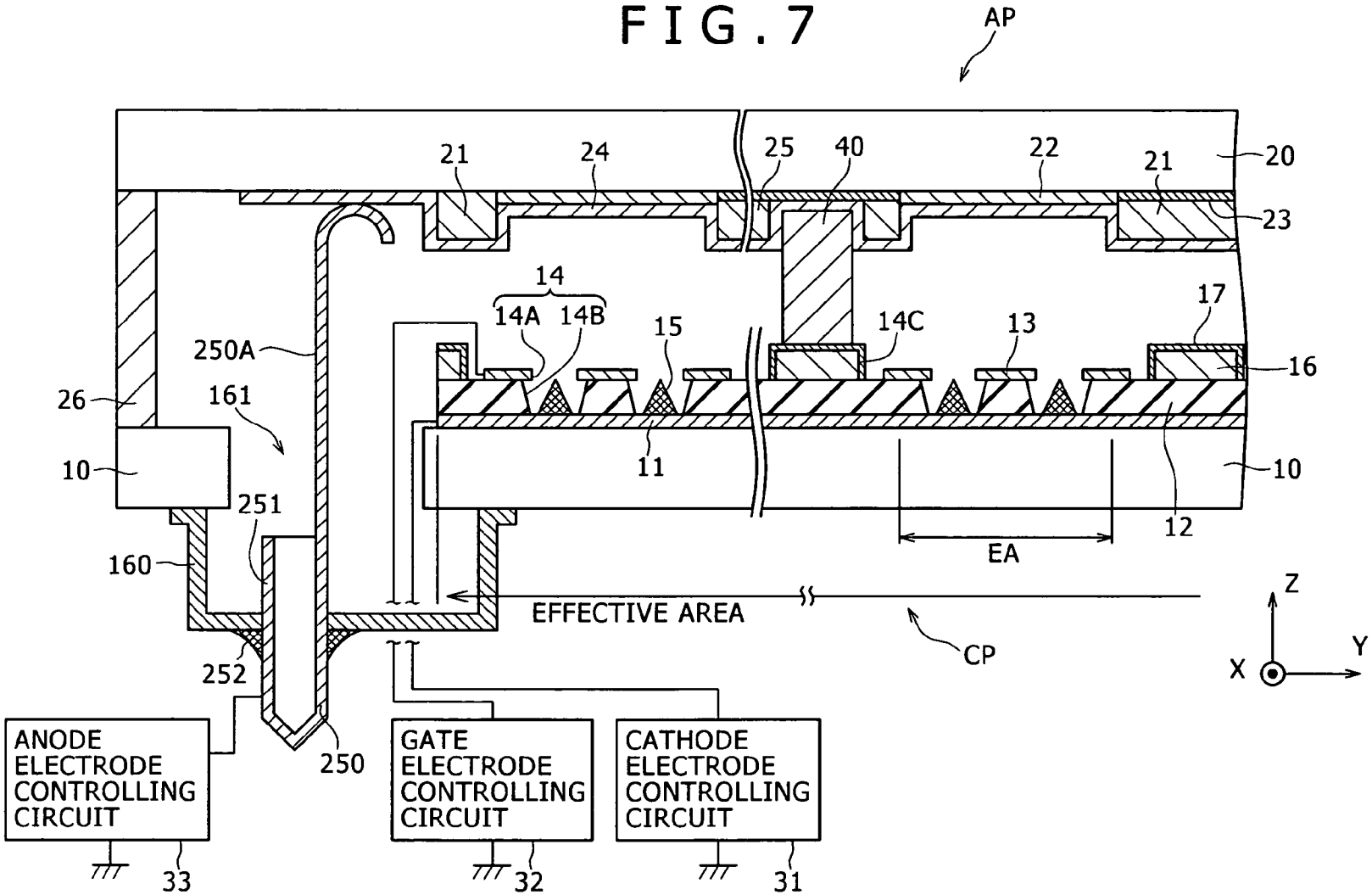
FIG. 7 is a conceptual partial end view of a plane display device according to Embodiment 2 of the present invention.
Figure 8:
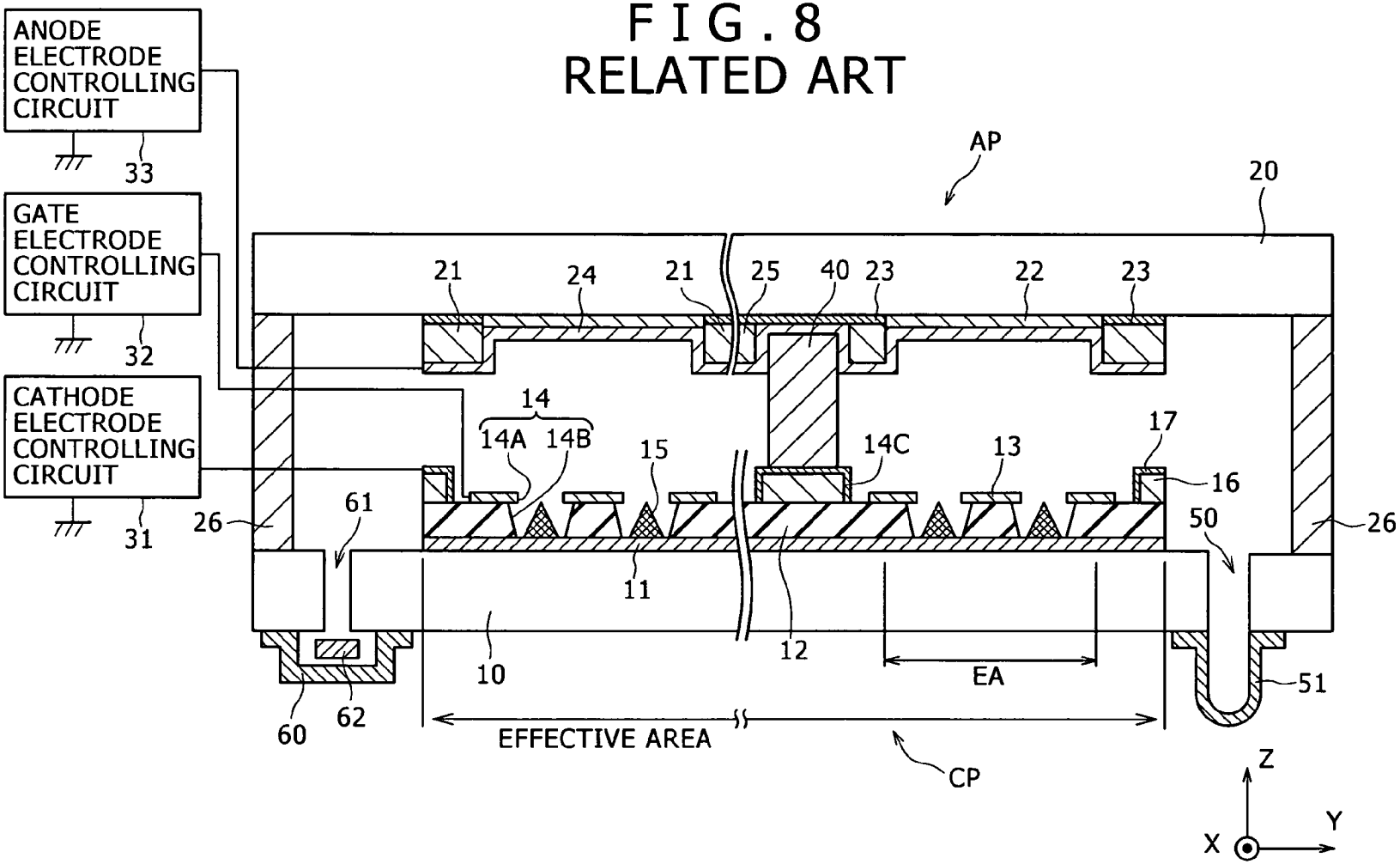
FIG. 8 RELATED ART
FIG. 8 is a conceptual partial end view of a plane display device having spindt field emission elements incorporated therein in the related art.

FIG. 7 shows a conceptual partial end view of a display device according to Embodiment 2 of the present invention. The display device of Embodiment 2 has the same construction and constitution as those of the display device of Embodiment 1 except for the construction and constitution of an exhaust tube portion. Thus, a detailed description of the entire display device is omitted here for the sake of simplicity. Hereinafter, the construction and constitution of the exhaust tube portion will be concretely described with reference to FIG. 7.

An exhaust tube 250 in the display device of Embodiment 2 is made of a conductive material (more specifically, a nickel alloy). One end portion 250A of the exhaust tube 250 communicates with a space (which is defined between the cathode panel CP and the anode panel AP and is kept at a vacuum), and the other end portion thereof is located outside the display device. Also, the one end portion 250A of the exhaust tube 250 directly contacts (that is, abuts against or is pressed to) the anode electrode 24. More specifically, the one end portion 250A of the exhaust tube 250 is constituted by a protrusion piece which has an elasticity and which extends from an exhaust main body 251. In addition, the other end portion of the exhaust tube 250 (an end portion of the exhaust main body 251) is located outside the display device, is bonded to the getter box 160 by the application of a pressure, and is sealed. Also, the anode electrode controlling circuit 33 applies the predetermined voltage (the anode voltage $V_A$) to the anode electrode 24 through the exhaust tube 250. A connection portion between the anode electrode controlling circuit 33 and the exhaust tube 250 can have the same constitution and construction as those of the connection portion 70 of the display device of Embodiment 1. Note that, the exhaust tube 250 is mounted to the getter box 160 which communicates with the space similarly to the exhaust tube 150 of the display device of Embodiment 1. More specifically, the exhaust main body 251 is mounted to the getter box 160 by using a frit glass 252.

Although the present invention has been described so far based on the preferred embodiments, the present invention is not intended to be limited thereto. That is to say, the constitutions and constructions of the plane display devices, the cathode panels, the anode panels, the exhaust tubes, the elastic members, the cold cathode field electron emission display devices, and the cold cathode field electron emitting elements which have been described in Embodiments 1 and 2 are merely exemplified, and thus can be suitably changed. In addition, the methods of manufacturing the cathode panel, the anode panel, the exhaust tube, the elastic member, the cold cathode field electron emission display device, and the cold cathode field electron emitting element are also merely exemplified, and thus can be suitably changed. Moreover, the various materials used in manufacturing the cathode panel, the anode panel, the exhaust tube, and the elastic member are merely exemplified, and thus can be suitably changed. Although the display device has been described by mainly giving the color display device as the example, the display device can also perform single color display.

The form in which one electron emitting portion exclusively corresponds to one opening portion has been described for the field emission element. However, a form in which a plurality of electron emitting portions correspond to one opening portion, or a form in which a plurality of electron emitting portions correspond to a plurality of opening portions can also be adopted depending on the structures of the field emitting elements. Or, a form can also be adopted in which a plurality of first opening portions are formed in each of the gate electrodes, a second opening portion communicating with corresponding one or ones of the plurality of first opening portions is formed in the insulating layer, and one or plural electron emitting portions are provided.

The electron emitting source can be constituted from the element commonly known as the surface-conduction electron emitting element. In the surface-conduction electron emitting element, pairs of electrodes are formed in matrix on the supporting body, for example, made of a glass. Here, a pair of electrodes are made of a conductive material such as a tin oxide ($SnO_2$), a gold (Au), an indium oxide ($In_2O_3$)/a tin oxide ($SnO_2$), carbon, or a palladium oxide (PdO), and has a minute area. Also, the pairs of electrodes are arranged at predetermined gaps. A carbon thin film is formed on each of the electrodes. Also, a row-direction wiring is connected to one of a pair of electrodes, and a column-direction wiring is connected to the other of the pair of electrons. A suitable voltage is applied each of a pair of electrodes, which result in that an electric field is applied to the carbon thin films facing each other through the given gap, and the carbon thin films emit the electrons. Such electrons are made to collide with the phosphor layers formed on the anode panel, so that the phosphor layers are excited to emit lights, thereby enabling a desired image to be obtained. Or, the electron emitting source can be constituted by the metal/insulating film/metal type element.

It should be understood by those skilled in the art that various modifications, combinations, sub-combinations and alterations may occur depending on design requirements and other factors insofar as they are within the scope of the appended claims or the equivalents thereof.

What is claimed is:

1. A plane display device in which a cathode panel having a plurality of electron emitting areas provided therein, and an anode panel having phosphor layers and an anode electrode provided therein are joined to each other in their peripheral portions, and a space defined between said cathode panel and said anode panel is kept at a vacuum, said plane display device, comprising:

a supporting body containing the cathode panel and the anode panel and having a supporting body hole extending therethrough;

a hollow exhaust tube made of a conductive material, said exhaust tube having a first end portion, a second end portion and an intermediate portion disposed between and integrally connected to the first and second end portions, the first end portion being disposed internally of the supporting body and in communication with the space, the second end portion disposed exteriorly of the supporting body and the intermediate portion being disposed in the supporting body hole and in contact with the supporting body; and an elastic member made of a conductive material;

wherein said exhaust tube and said anode electrode are electrically connected to each other through said elastic member disposed in said space with one end of the elastic member being in electrical contact with the anode electrode and an opposite end of the elastic member being in electrical contact with the first end portion of the exhaust tube; and a predetermined voltage is applied to said anode electrode through said exhaust tube and said elastic member such that the predetermined voltage drops in series through the second end portion, the intermediate portion, the first end portion of the exhaust tube and then to the elastic member.

2. The plane display device according to claim 1, wherein the supporting body includes a getter box communicating with said space, the getter box is mounted to at least one of said cathode panel and said anode panel; and said exhaust tube is mounted to said getter box.

3. The plane display device according to claim 2, wherein the exhaust tube is mounted to the getter box by using a frit glass disposed exteriorly of the supporting body and simultaneously contacting the second end portion of the exhaust tube and the supporting body.

4. The plane display device according to claim 1, wherein one end of said elastic member abuts against said anode electrode, and the other end of said elastic member is fixedly fastened to said exhaust tube.

5. A plane display device in which a cathode panel having a plurality of electron emitting areas provided therein, and an anode panel having phosphor layers and an anode electrode provided therein are joined to each other in their peripheral portions, and a space defined between said cathode panel and said anode panel is kept at a vacuum, said plane display device, comprising:

a supporting body containing the cathode panel and the anode panel and having a supporting body hole extending therethrough;

a hollow exhaust tube made of a conductive material, said exhaust tube having a first end portion, a second end portion and an intermediate portion disposed between and integrally connected to the first and second end portions, the first end portion being disposed internally of the supporting body and in communication with the space, the second end portion disposed exteriorly of the supporting body and the intermediate portion being disposed in the supporting body hole and in contact with the supporting body;

wherein the second end portion of said exhaust tube directly contacts said anode electrode; and a predetermined voltage is applied to said anode electrode through said exhaust tube such that the predetermined voltage drops in series through the second end portion, the intermediate portion and the first end portion of the exhaust tube and then to an elastic member.

6. The plane display device according to claim 5, wherein a getter box communicating with said space is mounted to at least one of said cathode panel and said anode panel; and said exhaust tube is mounted to said getter box.

7. The plane display device according to claim 6, wherein the exhaust tube is mounted to the getter box by using a frit glass disposed exteriorly of the supporting body and simultaneously contacting the second end portion of the exhaust tube and the supporting body.

* * * * *